US011874034B2

(12) United States Patent
Andou et al.

(10) Patent No.: US 11,874,034 B2
(45) Date of Patent: Jan. 16, 2024

(54) HEAT EXCHANGER

(71) Applicant: DAIKIN INDUSTRIES, LTD., Osaka (JP)

(72) Inventors: Tooru Andou, Osaka (JP); Hiroyuki Nakano, Osaka (JP); Shun Yoshioka, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 484 days.

(21) Appl. No.: 16/977,271

(22) PCT Filed: Feb. 22, 2019

(86) PCT No.: PCT/JP2019/006844

§ 371 (c)(1),
(2) Date: Sep. 1, 2020

(87) PCT Pub. No.: WO2019/167840

PCT Pub. Date: Sep. 6, 2019

(65) Prior Publication Data

US 2021/0010727 A1 Jan. 14, 2021

(30) Foreign Application Priority Data

Mar. 1, 2018 (JP) ..... 2018-036980

(51) Int. Cl.
*F28F 1/22* (2006.01)
*F25B 39/02* (2006.01)
*F28D 1/053* (2006.01)

(52) U.S. Cl.
CPC ..... *F25B 39/02* (2013.01); *F28D 1/05333* (2013.01); *F28F 1/22* (2013.01)

(58) Field of Classification Search
CPC ..... F28F 1/20; F28F 1/22; F28F 1/022; F28F 2255/16; F25B 39/02; F28D 1/05333
See application file for complete search history.

(56) References Cited

U.S. PATENT DOCUMENTS 5,513,432 A * 5/1996 Sasaki ..... F28D 1/0246 29/890.038
2006/0237178 A1 10/2006 Katoh et al.
(Continued)

FOREIGN PATENT DOCUMENTS

DE 3919515 A1 12/1990
EP 1236960 A1 9/2002
(Continued)

OTHER PUBLICATIONS

International Search Report issued in corresponding International Application No. PCT/JP2019/006844 dated Apr. 23. 2019 (4 pages).
(Continued)

*Primary Examiner* — Eric S Ruppert
(74) *Attorney, Agent, or Firm* — Osha Bergman Watanabe & Burton LLP

(57) ABSTRACT

A heat exchanger includes a heat transfer unit (HTU) including a heat transfer channel portion (HTCP) and auxiliary heat transfer portions (AHTPs). The HTCP and the AHTPs extend in a direction and are disposed in another direction being perpendicular to the direction. One of the AHTPs is an AHTP adjacent to the HTCP in another direction. When viewed from the direction, the AHTP is at an end of the HTU in another direction. A distance from the AHTP to the HTCP in another direction is defined as a length, in a case where the HTU further includes a plurality of HTCPs, the length is larger than a distance between adjacent ones of the HTCPs in another direction, and in a caser where the heat exchanger further includes a plurality of HTUs, the length is larger than a distance between the HTUs adjacent to each other in a direction different.

9 Claims, 23 Drawing Sheets

(56) References Cited

U.S. PATENT DOCUMENTS

| | | | | |
|---|---|---|---|---|
| 2013/0206376 | A1* | 8/2013 | Shikazono | F28D 1/0316 165/172 |
| 2014/0027098 | A1* | 1/2014 | Alahyari | F28F 1/16 165/172 |
| 2016/0054068 | A1 | 2/2016 | Matsuura et al. | |
| 2020/0217590 | A1* | 7/2020 | Maeda | F28F 1/022 |

FOREIGN PATENT DOCUMENTS

| | | | |
|---|---|---|---|
| JP | S6183890 | A | 4/1986 |
| JP | 2002-139282 | A | 5/2002 |
| JP | 2006-084096 | A | 3/2006 |
| JP | 2006-090636 | A | 4/2006 |
| JP | 2006-112732 | A | 4/2006 |
| JP | 2006-322698 | A | 11/2006 |
| JP | 2015-117874 | A | 6/2015 |
| WO | 9966281 | A1 | 12/1999 |
| WO | 2014/171095 | A1 | 10/2014 |

OTHER PUBLICATIONS

International Preliminary Report on Patentability issued in corresponding International Application No. PCT/JP2019/006844 dated Sep. 10, 2020 (13 pages).

Extended European Search Report issued in the counterpart European Patent Application No. 19760319.4, dated Mar. 17, 2021 (6 pages).

* cited by examiner

HEAT EXCHANGER

TECHNICAL FIELD

The present invention relates to a heat exchanger.

BACKGROUND

Conventional heat exchangers used in an air conditioner or the like include a small-diameter heat transfer tube unit that is formed by stacking heat transfer fin plates (see, for example, Patent Literature 1 (Japanese Unexamined Patent Application Publication No. 2006-90636) and the like).

When a heat exchanger is used as an evaporator in a low temperature environment, frosting may concentratedly occur in a part of the heat exchanger due to internal heat flux distribution. Then, blockage of an air passage may occur in the part where frosting has concentratedly occurred, and the performance of the heat exchanger may decrease.

SUMMARY

A heat exchanger according to one or more embodiments includes a heat transfer unit in which a heat transfer channel portion and auxiliary heat transfer portions, each of which extends in a first direction, are formed so as to be arranged in a second direction that intersects with or is perpendicular to the first direction. In the heat transfer unit, when seen in the first direction, a first auxiliary heat transfer portion that is one of the auxiliary heat transfer portions is formed at an end portion in the second direction. A first length of the first auxiliary heat transfer portion to a heat transfer channel portion that is adjacent in the second direction is larger than a distance between heat transfer channel portions that are adjacent to each other in the second direction in a case where a plurality of heat transfer channel portions exist in the heat transfer unit, or is larger than a distance between heat transfer units that are adjacent to each other in a third direction that is different from both of the first direction and the second direction in a case where a plurality of the heat transfer units are arranged in the third direction. Such a configuration can optimize the heat exchange performance of the entirety of the heat exchanger.

In a heat exchanger according to a one or more embodiments, the heat transfer unit is a unit in which the heat transfer channel portion and the auxiliary heat transfer portions are integrally formed by extrusion of aluminum. Such a heat exchanger can be easily manufactured.

In a heat exchanger according to one or more embodiments, when seen in the first direction, a thickness of each of the auxiliary heat transfer portions is smaller than twice a thickness of the heat transfer channel portion. Such a heat exchanger can be designed to be compact.

In a heat exchanger according to one or more embodiments, the first length S satisfies a condition of formula (1) below, where t is a thickness of the first auxiliary heat transfer portion when seen in the first direction. Heat exchange performance can be optimized when such a condition is satisfied.

$$s > 11\sqrt{t} \tag{1}$$

In a heat exchanger according to one or more embodiments, in the case where a plurality of the heat transfer units are arranged in the third direction, when seen in the first direction, a position of the heat transfer channel portion of one of the heat transfer units in the second direction and a position of the auxiliary heat transfer portion of an adjacent one of the heat transfer units in the second direction are arranged so as to overlap. Such a configuration can increase the heat exchange performance of the entirety of the heat exchanger.

In a heat exchanger according to one or more embodiments, a thickness t of the first auxiliary heat transfer portion when seen in the first direction is smaller than ½ of an imaginary outside diameter D of the heat transfer channel portion. The distance FP between the heat transfer units that are adjacent to each other in the third direction in the case where a plurality of the heat transfer units is arranged in the third direction satisfies a condition of formula (2) below. Heat exchange performance can be optimized when such a condition is satisfied.

$$0.3 < \frac{D}{FP} < 1.5 \tag{2}$$

In a heat exchanger according to one or more embodiments, the heat transfer channel portion includes an airflow-upstream portion, a middle portion, and an airflow-downstream portion from the end portion side in the second direction. A thickness of the heat transfer channel portion increases from the airflow-upstream portion toward the middle portion, and the thickness decreases from the middle portion toward the airflow-downstream portion. Such a configuration can make the heat flow rate distribution of air that passes through the inside of heat transfer unit uniform.

In a heat exchanger according to one or more embodiments, the heat transfer channel portion includes a plurality of pipes. Such a configuration enables a channel having an optimal channel cross-sectional area to be easily formed.

In a heat exchanger according to one or more embodiments, in the heat transfer channel portion, a cross-sectional area of a pipe formed in the airflow-upstream portion and/or the airflow-downstream portion is smaller than a cross-sectional area of a pipe formed in the middle portion.

In a heat exchanger according to one or more embodiments, in the second direction, a length of the airflow-upstream portion is smaller than a length of the airflow-downstream portion. Such a configuration can reduce a dead water zone.

In a heat exchanger according to one or more embodiments, in a case where a plurality of the heat transfer units are arranged in the third direction, a distance between a position of an end portion of one of the heat transfer units in the second direction and a position of an end portion of another of the heat transfer units in the second direction is larger than or equal to FP/4, where FP is the distance between the heat transfer units in the third direction. Such a configuration can make the heat flow rate distribution of air that passes through the inside of heat transfer unit uniform.

An air conditioner according to one or more embodiments includes the heat exchanger according to the above embodiments.

DETAILED DESCRIPTION

Hereafter, embodiments of a heat exchanger and an air conditioner will be described with reference to the drawings.

(1) Overview of Heat Exchanger

Figure 1:
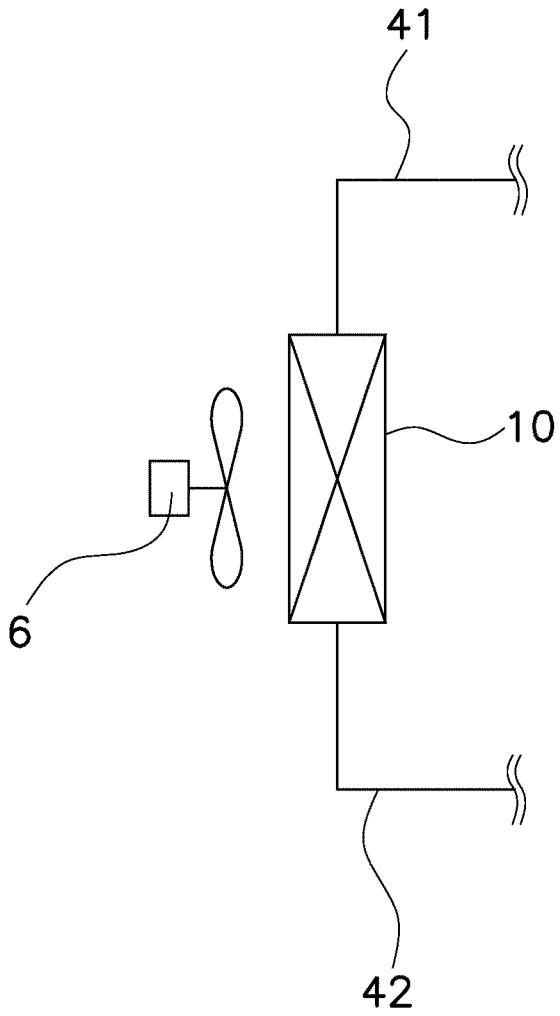
FIG. 1 is a schematic view illustrating the concept of a heat exchanger 10 according to one or more embodiments.

A heat exchanger 10 performs heat exchange between a fluid that flows inside and air that flows outside. For example, as conceptually illustrated in FIG. 1, a first pipe 41 and a second pipe 42, through which a refrigerant flows into or out from the heat exchanger 10, are attached to the heat exchanger 10. A fan 6, for sending air to the heat exchanger 10, is disposed near the heat exchanger 10. The fan 6 generates airflow toward the heat exchanger 10, and, when the airflow passes through the heat exchanger 10, heat exchange is performed between the heat exchanger 10 and air. The heat exchanger 10 functions as an evaporator that absorbs heat from air and as a condenser (radiator) that releases heat to air, and can be installed in an air conditioner or the like.

(2) Details of Heat Exchanger (2-1) Overall Configuration

Figure 2:
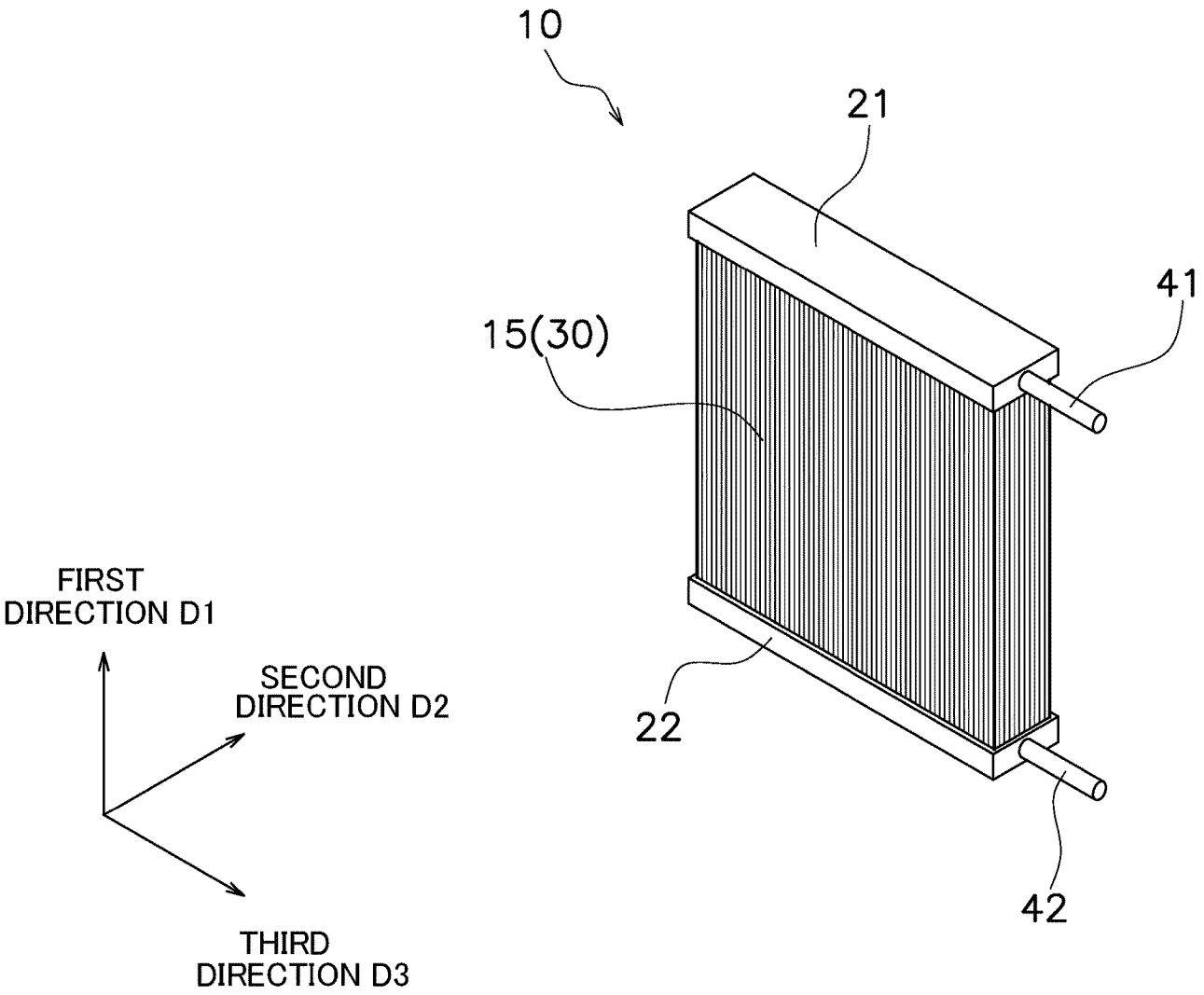
FIG. 2 is a schematic view illustrating the configuration of the heat exchanger 10 according to one or more embodiments.

As illustrated in FIG. 2, the heat exchanger 10 includes a heat transfer unit group 15, a first header 21, and a second header 22.

The heat transfer unit group 15 includes a plurality of heat transfer units 30. The heat transfer unit group 15 is disposed so that airflow generated by the fan 6 passes through spaces between the heat transfer units 30. Details of the arrangement of these members will be described below.

(2-2) Header

Figure 3:
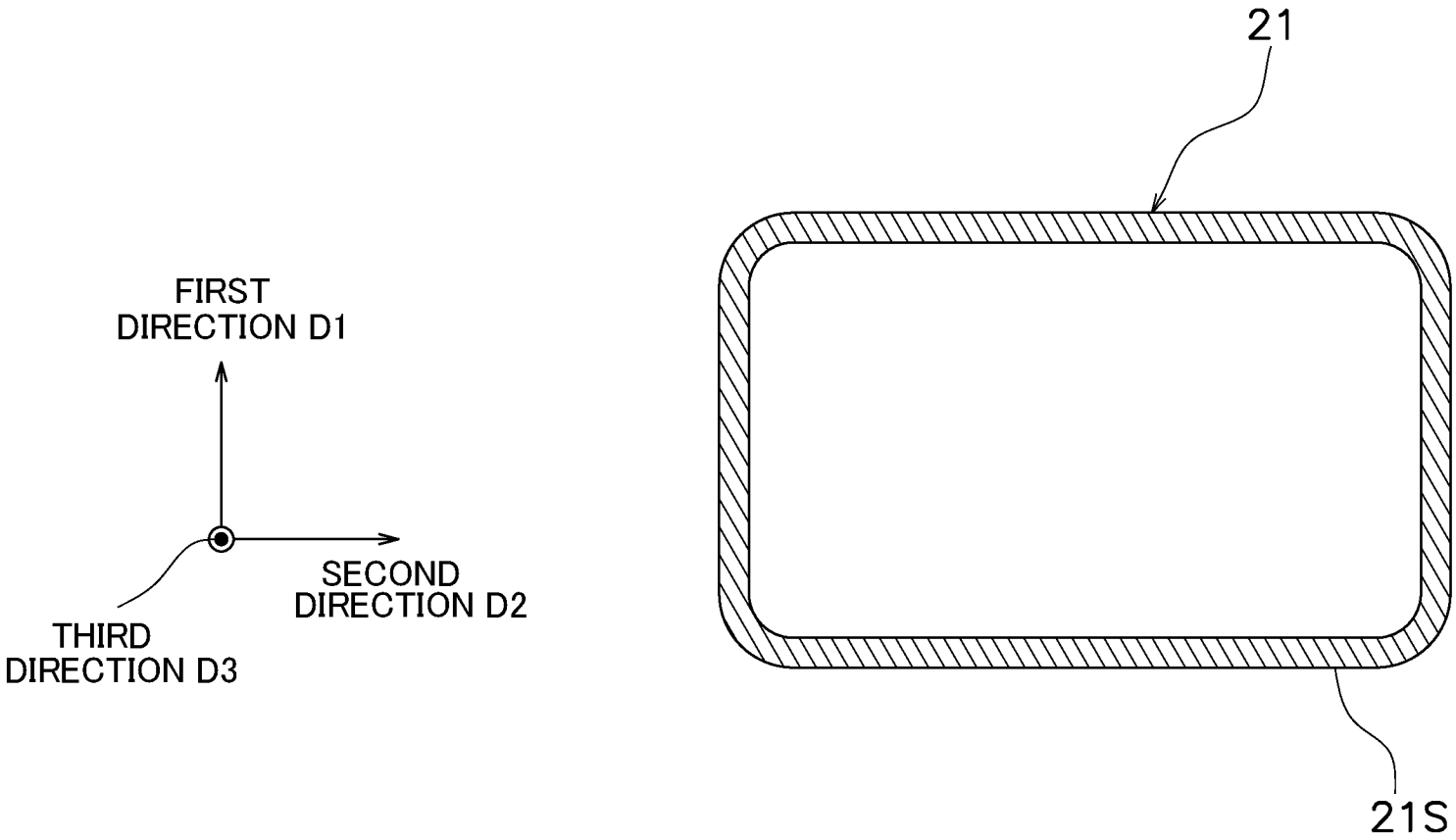
FIG. 3 is a schematic view illustrating the cross-sectional shape of a first header 21 according to one or more embodiments.

As illustrated in FIG. 3, the first header 21 is a hollow member that is configured so that a refrigerant in a gas phase, a liquid phase, and a gas-liquid two-phase can flow through the inside thereof. The first header 21 is connected to the first pipe 41 and to the heat transfer units 30 at a position above the heat transfer units 30. A connection surface 21S, to which the heat transfer units 30 are connected, is formed on the lower side of the first header 21. Coupling holes, into which end portions 31*e* of heat transfer channel portions 31 (described below) are inserted, are formed in the connection surface 21S. FIG. 3 illustrates a cross section of the first header 21 when seen in a third direction D3. The definition of the third direction D3 will be described below.

Figure 4:
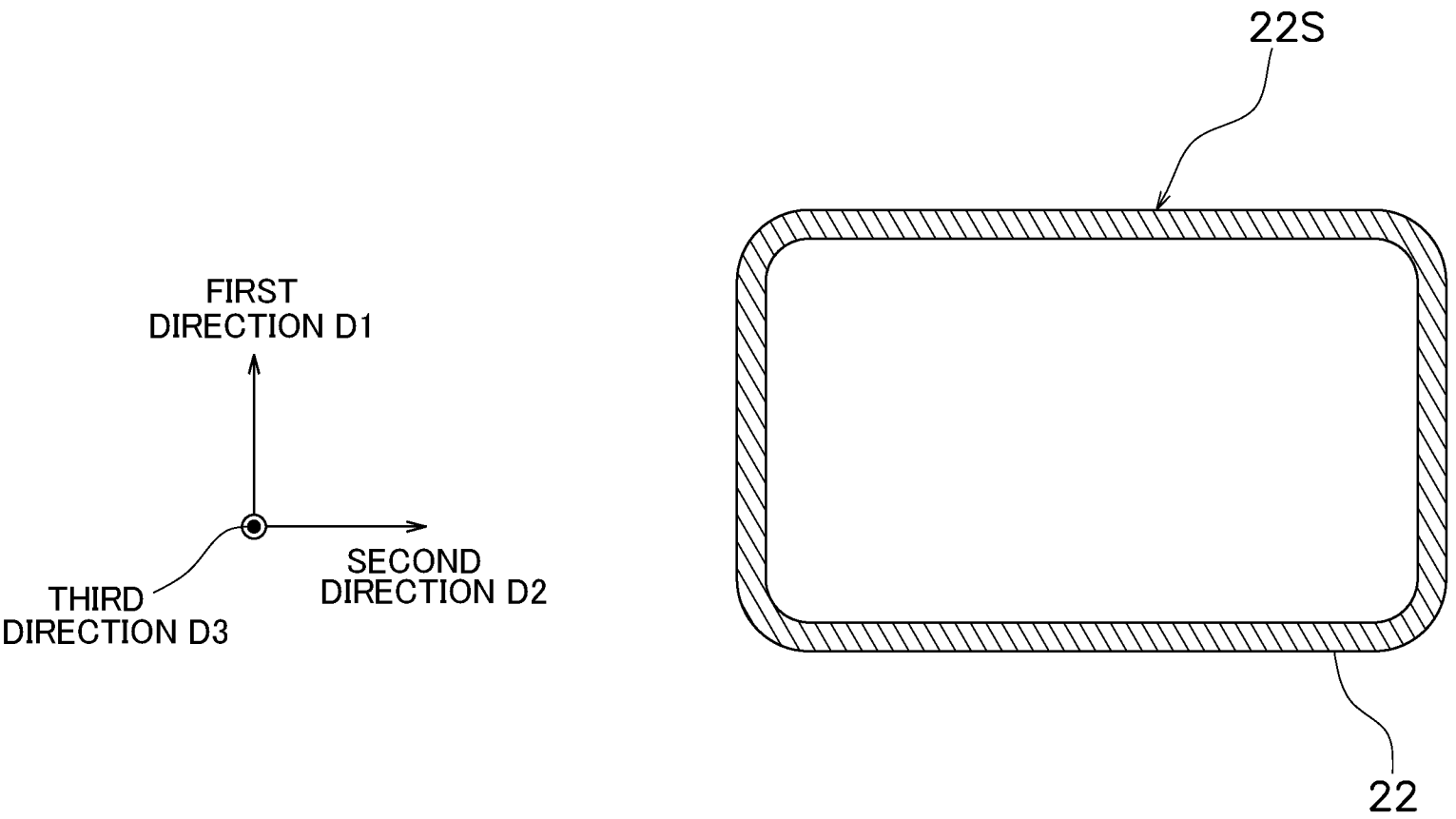
FIG. 4 is a schematic view illustrating the cross-sectional shape of a second header 22 according to one or more embodiments.

As illustrated in FIG. 4, as with the first header 21, the second header 22 is a hollow member that is configured so that a refrigerant in a gas phase, a liquid phases, and a gas-liquid two-phase can flow through the inside thereof. The second header 22 is connected to the second pipe 42 and to the heat transfer units 30 at a position below the heat transfer units 30. A connection surface 22S, to which the heat transfer units 30 are connected, is formed on the upper side of the second header 22. Coupling holes, into which end portions 31*e* of heat transfer channel portions 31 (described below) are inserted, are formed in the connection surface 22S. FIG. 4 illustrates a cross section of the second header 22 when seen in the third direction D3. The definition of the third direction D3 will be described below.

(2-3) Heat Transfer Unit (2-3-1)

Figure 5:
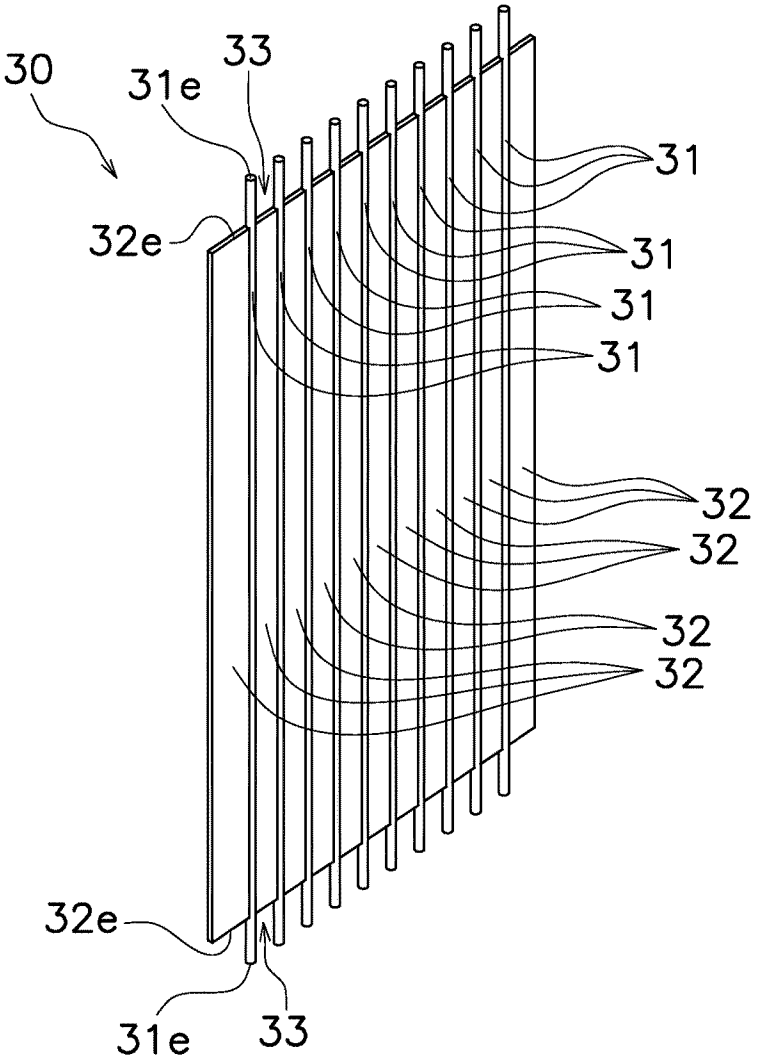
FIG. 5 is a schematic view illustrating the configuration of a heat transfer unit 30 according to one or more embodiments.
Figure 5:
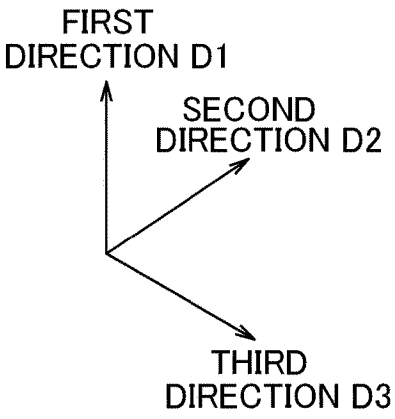
Figure 6:
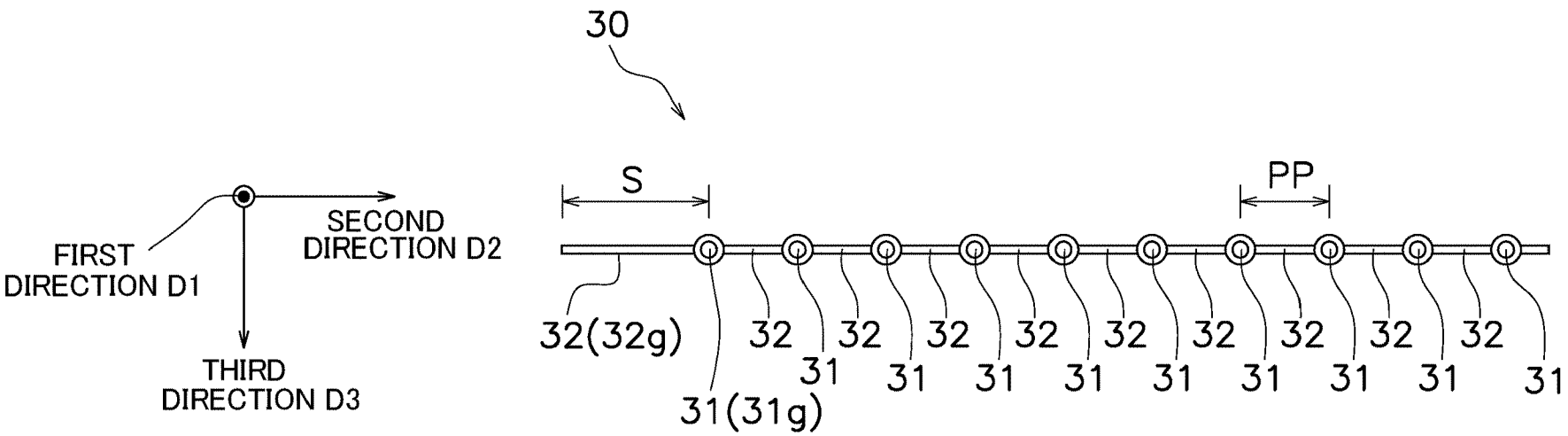
FIG. 6 is a schematic view for describing the configuration of the heat transfer unit 30 according to one or more embodiments.
Figure 7:
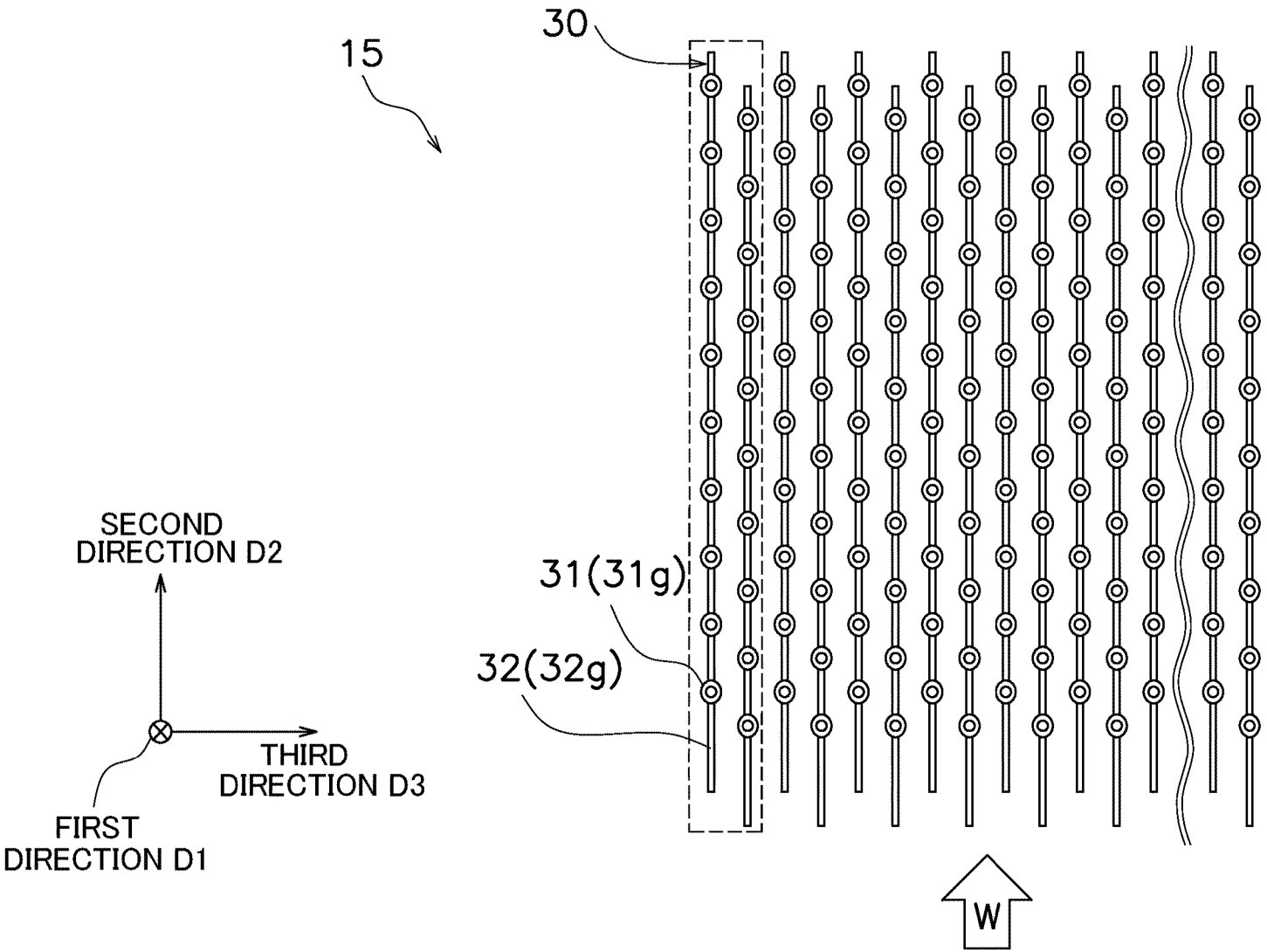
FIG. 7 is a schematic view for describing the configuration of a heat transfer unit group 15 according to one or more embodiments.

As illustrated in FIG. 5, in the heat transfer unit 30, a plurality of heat transfer channel portions 31 and a plurality of auxiliary heat transfer portions 32, each of which extends in a "first direction D1", are formed so as to be arranged in a "second direction D2" that intersects with or is perpendicular to the first direction D1. Here, the heat transfer channel portions 31 each have a substantially cylindrical shape, and the auxiliary heat transfer portions 32 each have a substantially flat plate-like shape. As illustrated in FIG. 6, the heat transfer channel portions 31 are formed so as to be arranged in the second direction D2 at a predetermined pitch PP. The heat transfer unit group 15 illustrated in FIG. 7 is formed by arranging such heat transfer units 30 in a "third direction D3" that is different from both of the first direction D1 and the second direction D2. Here, the heat transfer unit group 15 includes at least three or more heat transfer units 30 that are arranged in a stacked manner.

For convenience of description, it is assumed that the first direction D1, the second direction D2, and the third direction D3 are perpendicular to each other. However, these directions D1 to D3 need not be completely perpendicular to each other, and it is possible to realize the heat exchanger 10 according to one or more embodiments as long as these directions intersect with each other.

Figure 8:
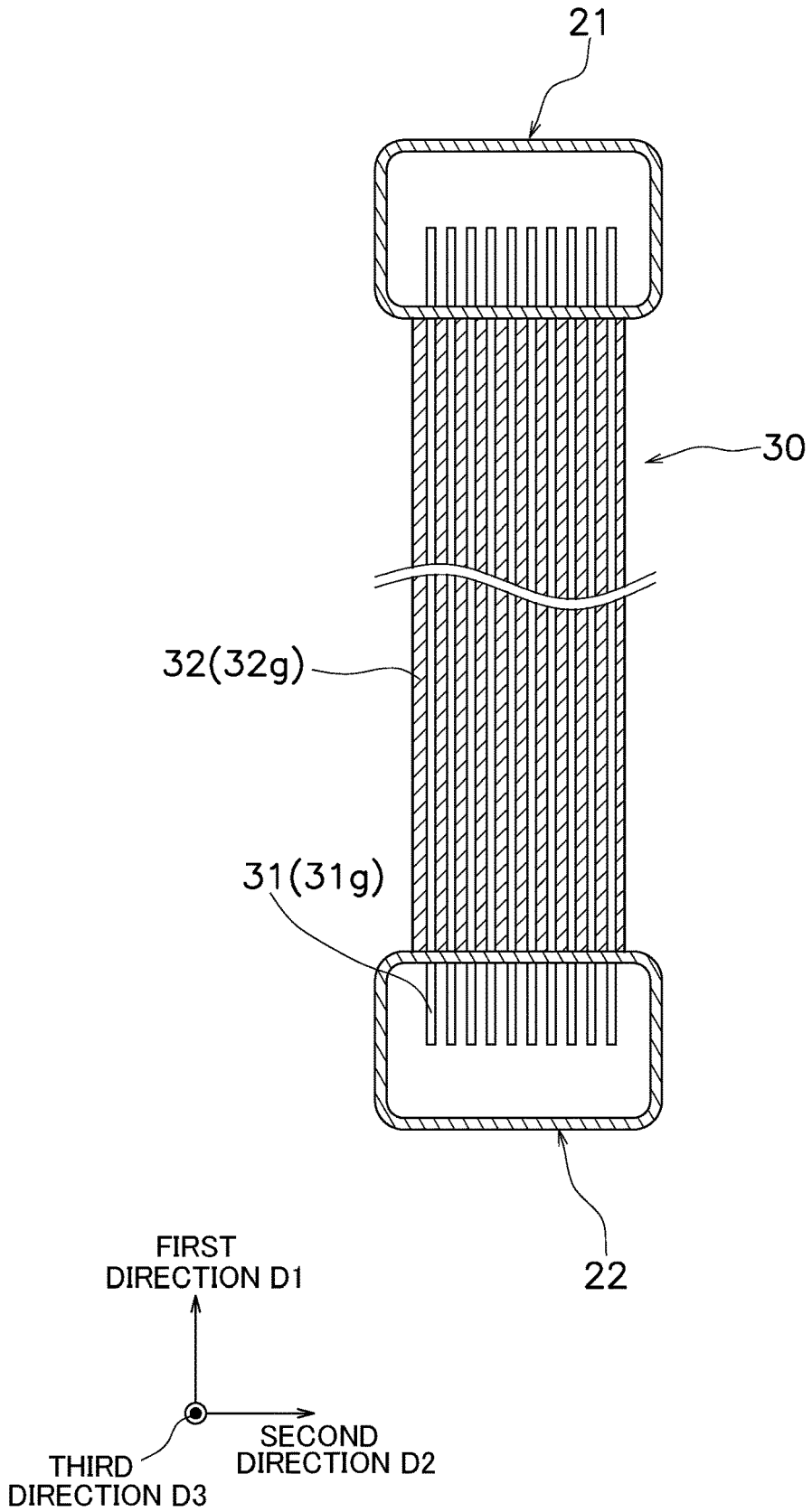
FIG. 8 is a schematic view illustrating the cross-sectional shape of the heat exchanger 10 according to one or more embodiments.

The heat transfer unit 30 is connected to the first header 21 and the second header 22 at the connection surfaces 21S and 22S of the first header 21 and the second header 22. To be specific, as illustrated in FIG. 5, at end portions of the heat transfer unit 30 in the first direction D1, end portions 31*e* of the heat transfer channel portions 31 protrude from end portions 32*e* of the auxiliary heat transfer portions 32. The end portions 31*e* of the heat transfer channel portions 31 are inserted into the coupling holes formed in the connection surfaces 21S and 22S of the first header 21 and the second header 22. The heat transfer unit 30 is fixed in place between the first header 21 and the second header 22 by, for example, brazing the connection portion (see FIG. 8).

The heat transfer channel portion 31 enables a refrigerant to move between the first header 21 and the second header 22. To be specific, a substantially cylindrical passage is formed in the heat transfer channel portion 31, and the refrigerant moves in the passage. The heat transfer channel portion 31 according to one or more embodiments has a linear shape in the first direction D1.

The auxiliary heat transfer portion 32 accelerates heat exchange between a refrigerant that flows in adjacent heat transfer channel portions 31 and ambient air. Here, as with the heat transfer channel portion 31, the auxiliary heat transfer portion 32 is formed so as to extend in the first direction D1 and is disposed so as to be in contact with the adjacent heat transfer channel portions 31. The auxiliary heat transfer portion 32 may be integrally formed with or may be independently formed from the heat transfer channel portions 31.

(2-3-2)

Figure 9:
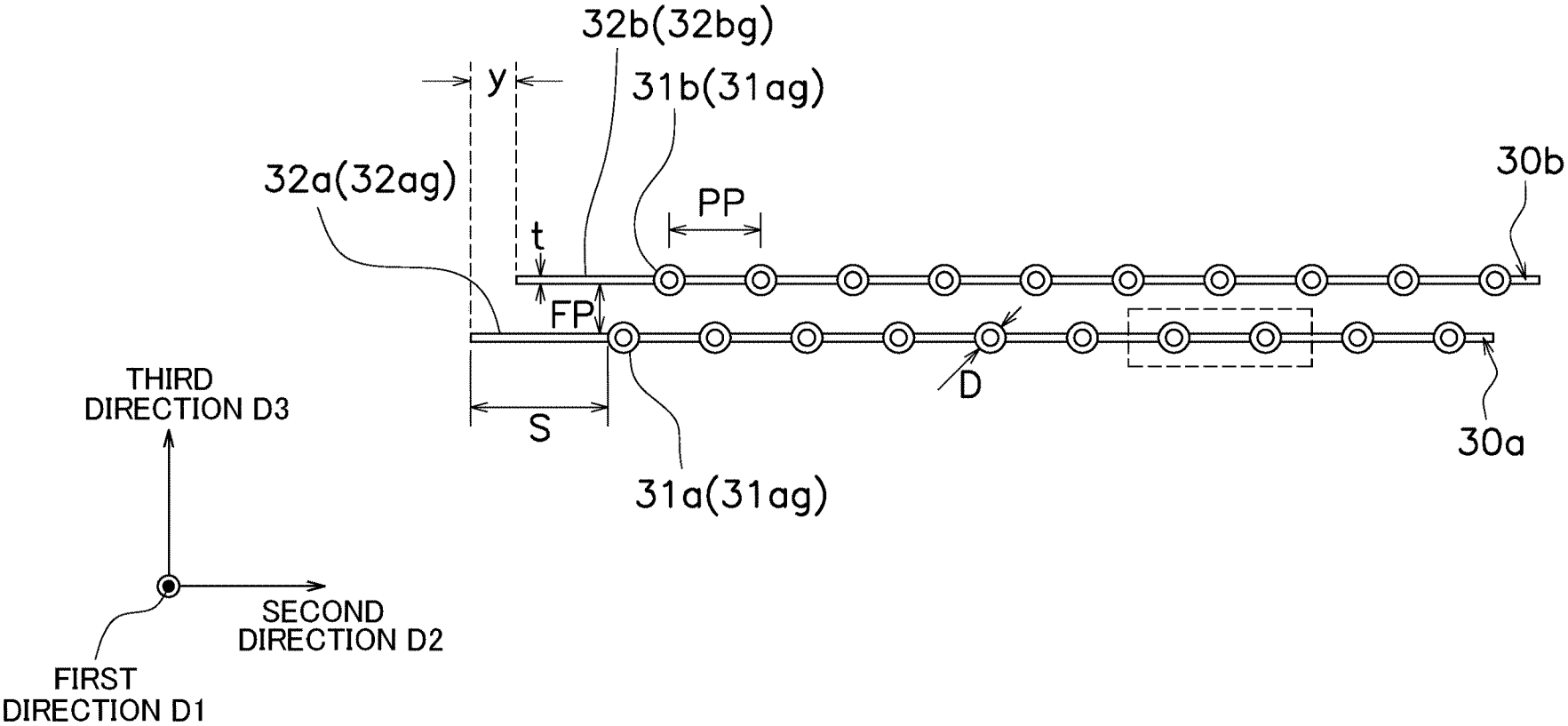
FIG. 9 is a schematic view for describing the configuration of the heat transfer unit 30 according to one or more embodiments (a partial enlarged view of FIG. 7).

Referring to FIG. 9, the specific configuration of the heat transfer unit 30 according to one or more embodiments will be described. FIG. 9 is a partial enlarged view of FIG. 7 (corresponding to a dotted-line part of FIG. 7).

In the heat transfer unit 30 according to one or more embodiments, when seen in the first direction D1, a first auxiliary heat transfer portion 32*g* (including 32*ag* and 32*bg*), which is one of the auxiliary heat transfer portions 32, is formed at an end portion in the second direction D2. The first auxiliary heat transfer portion 32*g* is configured so that a first length S to a heat transfer channel portion 31*g* (including 31*ag* and 31*bg*) that is adjacent in the second direction D2 is larger than the distance PP between other heat transfer channel portions 31 of the heat transfer unit 30 that are adjacent to each other in the second direction D2 (see FIGS. 6 and 9).

The first length S in one heat transfer unit 30*a* is larger than the distance FP between heat transfer units 30*a* and 30*b* that are adjacent in the third direction D3.

When seen in the first direction D1, the position of a heat transfer channel portion 31*a* of one of the heat transfer units 30*a* in the second direction and the position of an auxiliary heat transfer portion 32*b* of an adjacent heat transfer unit 30*b* in the second direction D2 are arranged so as to overlap. In other words, as illustrated in FIG. 9, the heat transfer channel portions 31 of the adjacent heat transfer units 30*a* and 30*b* are arranged in a staggered pattern.

As illustrated in FIG. 9, the distance y between the position of an end portion of the one heat transfer unit 30*a* in the second direction D2 and the position of an end portion of the other heat transfer unit 30*b* in the second direction D2 is larger than or equal to FP/4, where FP is the distance between the heat transfer units 30*a* and 30*b* in the third direction D3.

Figure 10:
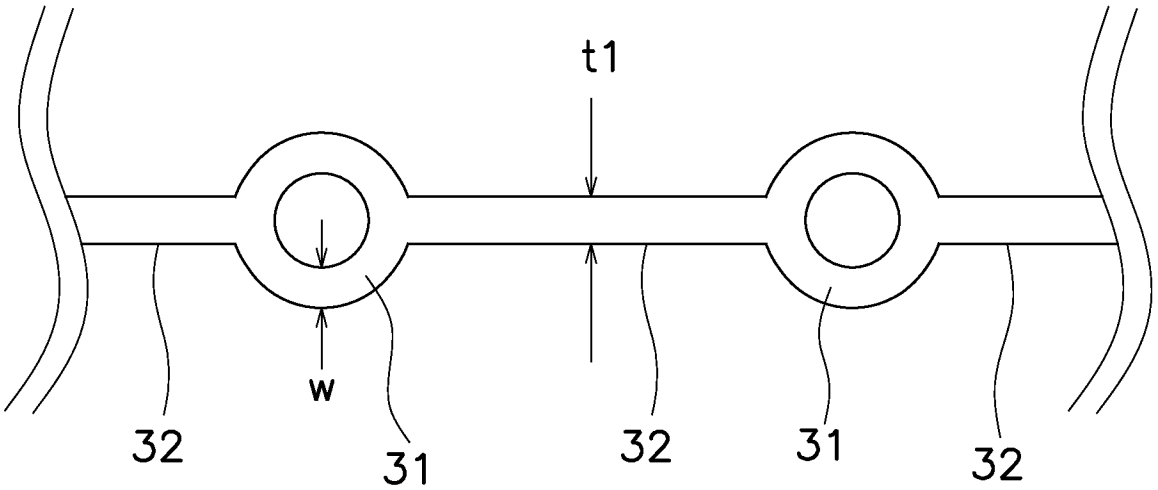
FIG. 10 is a schematic view for describing the configuration of the heat transfer unit 30 according to one or more embodiments (a partial enlarged view of FIG. 9).

When seen in the first direction D1, the thickness t1 of the auxiliary heat transfer portion 32 is smaller than twice the thickness of an outer wall member w of the heat transfer channel portion 31 (see FIG. 10). FIG. 10 is a partial enlarged view of FIG. 9 (corresponding to a dotted-line part of FIG. 9).

(2-4) Refrigerant Channel

Figure 11:
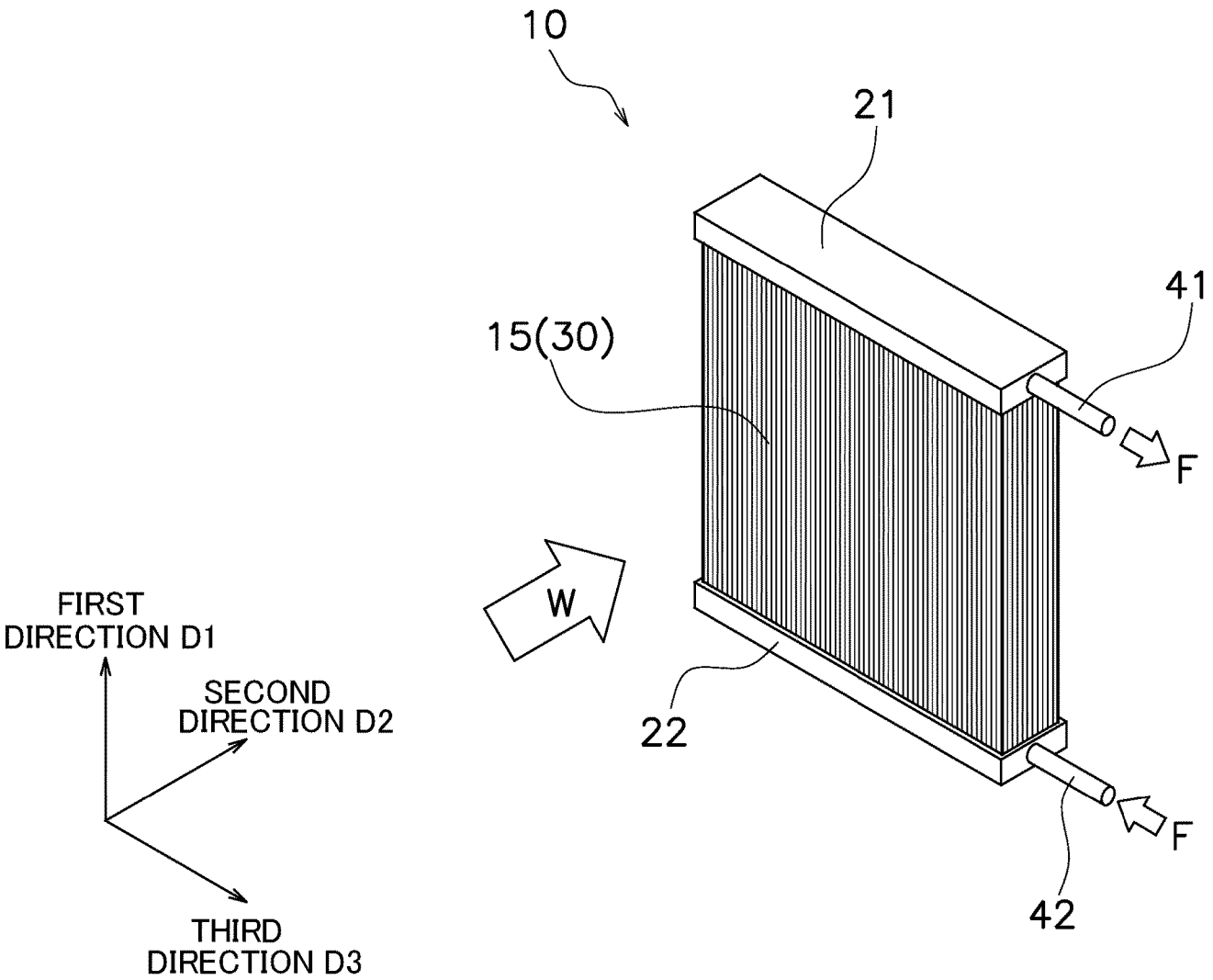
FIG. 11 is a view for describing a refrigerant channel of the heat exchanger 10 according to one or more embodiments.

When the heat exchanger 10 is used as an evaporator, airflow W that is generated by the fan 6 flows in the second direction D2 as illustrated in FIG. 11. In this state, a refrigerant F in a liquid phase flows into the heat exchanger 10 from the second pipe 42. Next, the refrigerant F flows into the second header 22 from the second pipe 42. Then, the refrigerant F flows from a lower position to an upper position via the heat transfer channel portions 31, which are connected to the second header 22. While the refrigerant F flows through the heat transfer channel portions 31, the refrigerant F exchanges heat with the airflow W. Thus, the refrigerant F evaporates and changes into a gas phase. Then, the refrigerant F in the gas phase flows out from the first pipe 41.

When the heat exchanger 10 is used as a condenser, the refrigerant F flows in a direction opposite from that when the heat exchanger 10 is used as an evaporator. That is, the refrigerant F in a gas phase flows through the first pipe 41 to the heat exchanger 10, and the refrigerant F in a liquid phase flows through the second pipe 42 out from the heat exchanger 10.

(3) Method of Manufacturing Heat Exchanger 10

The heat transfer unit 30 is manufactured from, for example, a metal material such as aluminum or an aluminum alloy. To be specific, first, extrusion of a metal material is performed by using a die corresponding to the cross-sectional shape of FIG. 5, and the heat transfer channel portions 31 and the auxiliary heat transfer portions 32 are integrally formed. Next, cutouts 33 are formed by cutting off parts of the auxiliary heat transfer portions 32. The cutouts 33 are formed, for example, by punching and cutting off a plurality of parts of the auxiliary heat transfer portions 32.

The first header 21 and the second header 22 are manufactured by processing a metal material into a tubular shape. Coupling holes for inserting the end portions 31*e* of the heat transfer channel portions 31 are formed in the first header 21 and the second header 22. The coupling holes are circular through-holes that are formed by using, for example, a drill.

In assembling the heat exchanger 10, the end portions 31*e* of the heat transfer channel portions 31 of the heat transfer units 30 are inserted into the coupling holes of the first header 21 and the second header 22. Thus, the end portions 32*e* of the auxiliary heat transfer portions 32 are brought into contact with the connection surfaces 21S and 22S of the first header 21 and the second header 22. At the contact portions, the heat transfer units 30, the first header 21, and the second header 22 are fixed by, for example, brazing.

(4) Features (4-1)

As heretofore described, the heat exchanger 10 according to one or more embodiments includes the heat transfer unit 30 in which the heat transfer channel portions 31 and the auxiliary heat transfer portions 32, each of which extends in the first direction D1, are formed so as to be arranged in the second direction D2 that intersects with or is perpendicular to the first direction D1. Here, a plurality of heat transfer units 30 are arranged in the third direction D3 that is different from both of the first direction D1 and the second direction D2, and form the heat transfer unit group 15.

In the heat transfer unit 30, when seen in the first direction D1, the first auxiliary heat transfer portion 32*g*, which is one of the auxiliary heat transfer portions 32, is formed at an end portion in the second direction D2. The first auxiliary heat transfer portion 32*g* is configured so that the first length S to the heat transfer channel portion 31*g* that is adjacent in the second direction D2 is larger than the distance PP between the heat transfer channel portions 31 of the heat transfer unit 30 that are adjacent to each other in the second direction D2. The heat transfer unit 30 is configured so that the first length S is larger than the distance FP between the heat transfer units 30 that are adjacent to each other in the third direction D3.

With such a heat exchanger 10, because the distance (the first length S), in the heat transfer channel portion 31*g* on the most airflow-upstream side, to the adjacent auxiliary heat transfer portion 32*g* is large, the amount of heat that is transferred from the heat transfer channel portions 31*g* on the most airflow-upstream side to the auxiliary heat transfer portion 32*g* can be reduced. Thus, heat flux distribution on the surface of the heat transfer unit 30 can be made uniform. As a result, when the heat exchanger 10 is used as an evaporator in a low temperature environment (for example, 7° C. or lower), occurrence of frosting locally at an inlet portion of the air passage can be suppressed or avoided.

The heat exchanger 10 according to one or more embodiments is not limited to the configuration described here. For example, the heat exchanger 10 may have a configuration according to any of modifications described below.

(4-2)

In the heat exchanger 10 according to one or more embodiments, when seen in the first direction D1, the position of the heat transfer channel portion 31*a* of one heat transfer units 30*a* in the second direction D2 and the position of the auxiliary heat transfer portion 32*b* of an adjacent heat transfer unit 30*b* in the second direction D2 are arranged so as to overlap. In short, in the heat exchanger 10 having such a configuration, as illustrated in FIG. 7, when seen in the first direction D1, the heat transfer channel portions 31 and the auxiliary heat transfer portions 32 are arranged in a staggered pattern. Thus, the heat exchange performance of the entirety of the heat exchanger can be increased.

Figure 12:
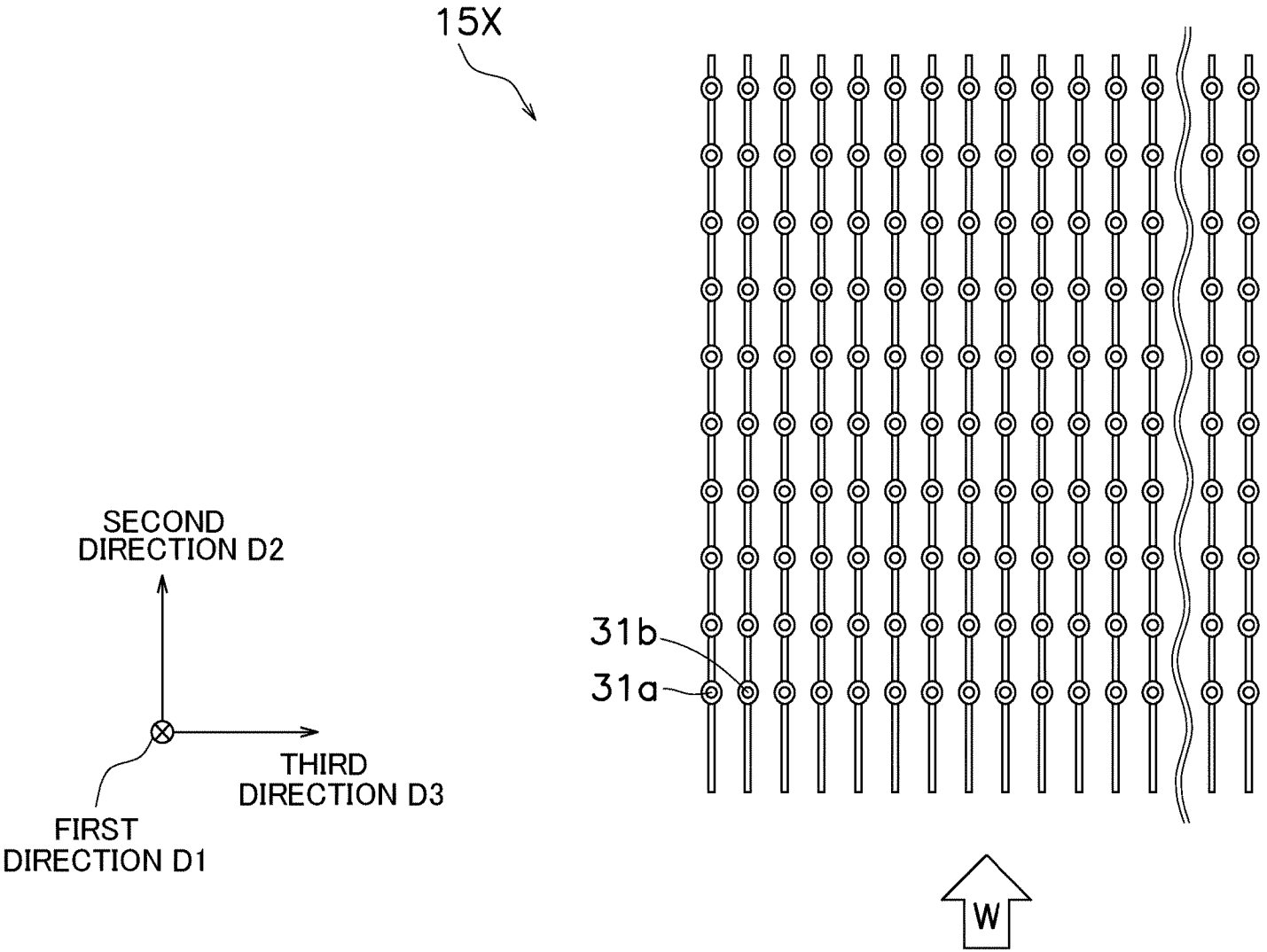
FIG. 12 is a schematic view illustrating the configuration of a heat transfer unit group 15X for comparison.

To be more specific, with the heat transfer unit group 15 having a configuration illustrated in FIG. 7, the cross-sectional area of an air passage can be made large, compared with a heat transfer unit group 15X having a configuration illustrated in FIG. 12. That is, in the heat transfer unit group 15X illustrated in FIG. 12, when seen in the first direction D1, the position of the heat transfer channel portion 31*a* of one heat transfer unit 30*a* in the second direction D2 and the position of the heat transfer channel portion 31*b* of an adjacent heat transfer unit 30*b* in the second direction D2 overlap. Therefore, in the heat transfer unit group 15X illustrated in FIG. 12, bulging portions of the heat transfer channel portions 31*a* and 31*b* are arranged so as to face each other in the third direction D3, and the cross-sectional area of an air passage is small, compared with the heat transfer unit group 15 illustrated in FIG. 7. In other words, the heat transfer unit group 15 illustrated in FIG. 7, in which the cross-sectional area of an air passage is larger than that of the heat transfer unit group 15X illustrated in FIG. 12, can increase the heat exchange performance of the entirety of the heat exchanger.

However, the heat exchanger 10 according to one or more embodiments does not exclude the heat transfer unit group 15X illustrated in FIG. 12.

(4-3)

In the heat exchanger 10 according to one or more embodiments, as illustrated in FIG. 9, the distance y between the position of an end portion of the one heat transfer unit 30*a* in the second direction D2 and the position of an end portion of the other heat transfer unit 30*b* in the second direction D2 is larger than or equal to FP/4, where FP is the distance between the heat transfer units 30*a* and 30*b* in the third direction D3.

With such a configuration, the heat flux distribution of air that passes through the inside of the heat transfer unit group 15 can be made uniform. Moreover, because the end portions of the first auxiliary heat transfer portions 32*g* are arranged in a staggered pattern, a portion having a large cross-sectional area is formed at an inlet part of the air passage. Accordingly, when the heat exchanger 10 is used as an evaporator, the generation amount of frost can be suppressed. As a result, blockage of the air passage due to frosting can be avoided.

(4-4)

The heat exchanger 10 according to one or more embodiments further includes the first header 21 (upper header) and the second header 22 (lower header) that are connected to the heat transfer units 30 from above and below in the first direction D1 and that form a part of the refrigerant channel. With such a configuration, the longitudinal direction of the heat transfer units 30 can be directed in the vertical direction, and water adhered to the heat transfer units 30 (due condensation water and the like) can be easily discharged. Moreover, ease of assembling and processing can be also increased.

However, the heat exchanger 10 according to one or more embodiments does not exclude a configuration such that the first header 21 and the second header 22 are arranged in the left-right direction instead of the up-down direction.

(4-5)

In the heat exchanger 10 according to one or more embodiments, each heat transfer unit 30 can be formed from a single member by extrusion of a metal material. The plurality of cutouts 33 can be simultaneously formed by punching. Accordingly, it is possible to provide the heat exchanger 10 that can be easily assembled and processed. For example, as such a heat transfer unit 30, a unit in which the heat transfer channel portions 31 and the auxiliary heat transfer portions 32 are integrally formed by extrusion of aluminum can be used.

(4-6)

In the heat transfer unit 30 according to one or more embodiments, when seen in the first direction D1, the thickness t1 of the auxiliary heat transfer portion 32 is smaller than twice the thickness w of the heat transfer channel portion 31. For example, such a configuration can be realized by forming the heat transfer unit 30 by extrusion. When the thickness t1 of the auxiliary heat transfer portion 32 is smaller than twice the thickness w of the heat transfer channel portion 31, the first length S of the first auxiliary heat transfer portion 31*g* can be shortened, compared with other configurations. As a result, the size of the heat exchanger 10 can be reduced.

To be more specific, in a heat transfer unit that is formed by stacking two fin plates having a substantially uniform thickness, the thickness w of the auxiliary heat transfer portion 32 is twice the thickness t1 of the heat transfer channel portion 31. Therefore, in order to provide the heat transfer channel portion 31 with sufficient pressure resistance, the thickness t1 of the auxiliary heat transfer portions 32 increases. When the thickness t1 increases, frosting becomes more likely to occur at a distal end portion of the auxiliary heat transfer portion 32 on the airflow-upstream side (the first auxiliary heat transfer portion 32*g*). In order to avoid frosting, it is necessary to increase the first length S of the first auxiliary heat transfer portion 32. In contrast, when the heat transfer units 30 is formed by extrusion, sufficient pressure resistance can be provided even if the thickness of the heat transfer channel portions 31 is reduced. As a result, the first length S can be shortened, and the size of the heat exchanger can be reduced.

(5) Modifications (5-1) Modification A

Although the heat exchanger 10 according to one or more embodiments includes the heat transfer unit group 15 having a configuration described above, the heat exchanger 10 is not limited to such a configuration.

The heat exchanger 10 according to one or more embodiments may have any configuration such that the first length S, in the first auxiliary heat transfer portion 32*g*, to a heat transfer channel portion 31*g* that is adjacent in the second direction D2 is larger than the distance PP between the heat transfer channel portions 32 that are adjacent to each other in the second direction D2, in a case where a plurality of heat transfer channel portions 31 exist in the heat transfer units 30. In other words, in the heat exchanger 10 according to one or more embodiments, the heat transfer units 30 need not be arranged in the third direction D3. Also with such a configuration, because the first length S of the heat transfer channel portion 31*g* on the most airflow-upstream side is large, the amount of heat transferred from the heat transfer channel portion 31*g* on the most airflow-upstream side to the auxiliary heat transfer portion 32*g* can be reduced.

The heat exchanger 10 according to one or more embodiments may have any configuration such that the first length S of the first auxiliary heat transfer portion 32*g* is larger than the distance FP between the heat transfer units 30*a* and 30*b* that are adjacent to each other in the third direction D3 in a case where a plurality of heat transfer units 30 are arranged in the third direction D3 that is different from both of the first direction D1 and the second direction D2. In other words, in the heat exchanger 10 according to one or more embodiments, a plurality of heat transfer channel portions 31 need not exist in the heat transfer unit 30. Also with such a configuration, because the distance between the heat transfer channel portion 31*g* on the most airflow-upstream side and an adjacent auxiliary heat transfer portion 32*g* (first length S) is large, the amount of heat transferred from the heat transfer channel portion 31*g* on the most airflow-upstream side to the auxiliary heat transfer portion 32*g* can be reduced.

(5-2) Modification B

In the heat exchanger 10 according to one or more embodiments, the first length S may satisfy the condition of formula (1) below, where t is the thickness of the first auxiliary heat transfer portion 32*g* when seen in the first direction D1. With the heat exchanger 10 that satisfies the condition of formula (1) below, heat exchange performance can be optimized. In particular, when the heat exchanger 10 is used as an evaporator, frosting can be suppressed, and air passage resistance can be optimized.

$$s > 11\sqrt{t} \tag{1}$$

To be more specific, the inventors found that, when the condition of formula (1) is satisfied, heat flux at the distal end of the first auxiliary heat transfer portion 32*g* is lower than or equal to that at the vertex of the heat transfer channel portion 31*g*. The inventors also found that, when the condition of formula (1) is satisfied, even when the heat exchanger 10 is used as an evaporator in a low temperature environment (for example, 7° C. or lower), concentration of frosting on the distal end of the first auxiliary heat transfer portion 32*g* can be avoided.

Figure 13:
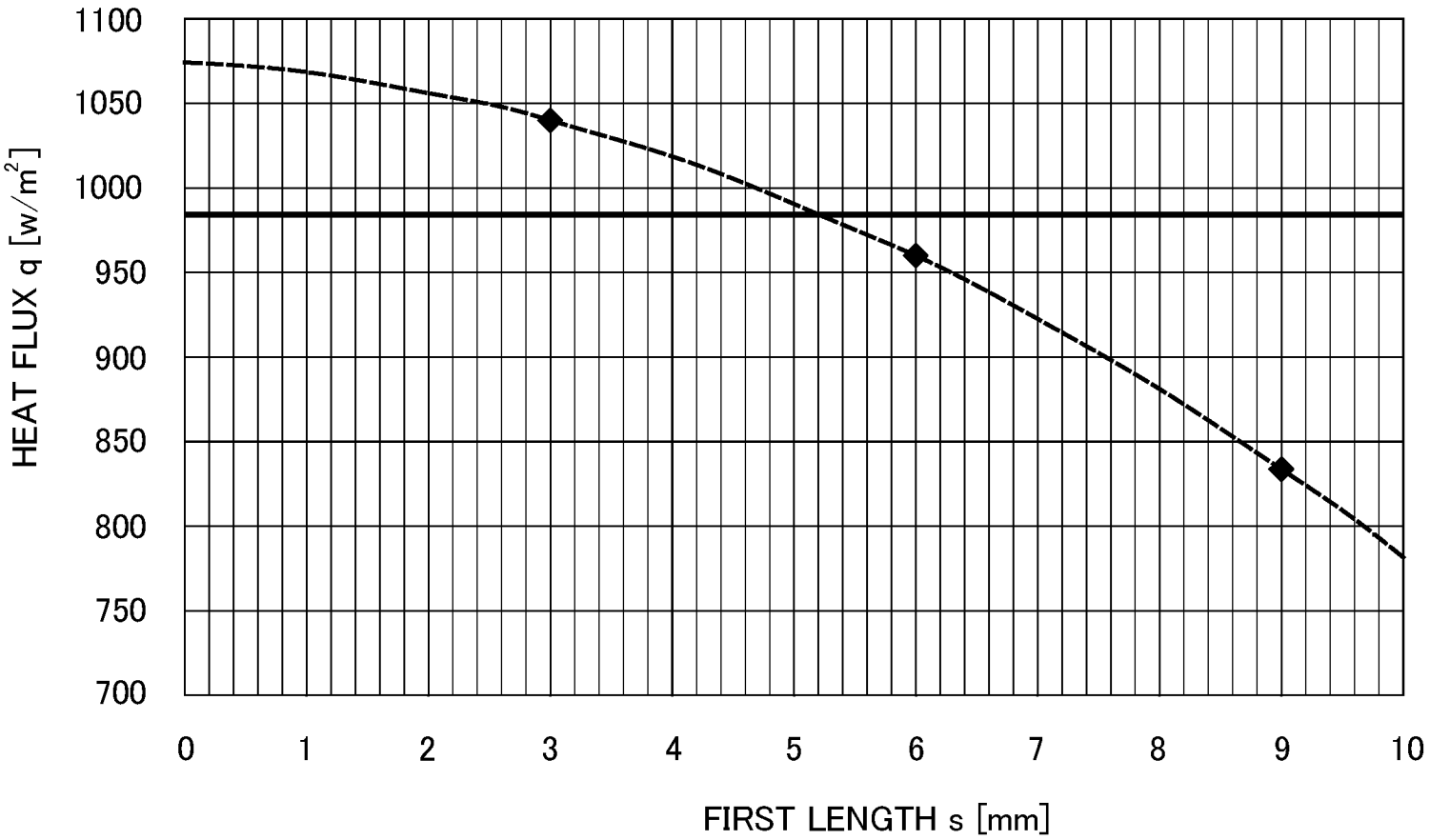
FIG. 13 is a graph showing the result of simulation of a heat exchanger 10 according to a modification B.

For example, the inventors performed a simulation, on the assumption that the heat exchanger 10 is configured as follows: FP=2.05 mm, where FP is the distance between adjacent heat transfer units 30*a* and 30*b*; PP=1.7 mm, where PP is the distance between adjacent heat transfer channel portions 31; D=1.0 mm, where D is the imaginary outside diameter of the heat transfer channel portion; W=38 mm, where W is the length of the heat transfer unit 30 in the second direction D2; and t=0.2 mm, where t is the thickness of the first auxiliary heat transfer portion 32*g*. The simulation conditions were as follows: the air temperature was 7° C., the airflow speed was 1.8 m/s, the refrigerant temperature was 0° C., the heat transfer coefficient of the inside of the heat transfer channel portions 31 was 6407 W/m2·K. The inventors obtained a result that, under such conditions, as illustrated in FIG. 13, heat flux at the distal end of the first auxiliary heat transfer portion 32*g* is lower than or equal to that at the vertex of the heat transfer channel portions 31*g* when the first length S=5.2 mm or larger. Here, the efficiency η of the first auxiliary heat transfer portion 32*g* is defined as the quotient of the heat exchange amount of the actual auxiliary heat transfer portion 32*g* divided by the heat exchange amount in a case where the temperature of the entire surface of the auxiliary heat transfer portion 32*g* is equal to the base temperature. Here, the efficiency η is determined by the quotient of the first length S divided by the square root of the thickness t.

(5-3) Modification C

In the heat exchanger 10 according to one or more embodiments, the thickness t of the first auxiliary heat transfer portion 32*g* when seen in the first direction D1 may be smaller than ½ of the imaginary outside diameter D of the heat transfer channel portion 31. Here, the "imaginary outside diameter D" is defined as the outside diameter of a circular pipe that allows a refrigerant to flow therethrough at the same flow rate as the heat transfer channel portion 32. The distance FP between adjacent heat transfer units 30*a* and 30*b* in the third direction D3 when a plurality of heat transfer units 30 are arranged in the third direction D3 may satisfy the condition of formula (2) below.

$$0.3 < \frac{D}{FP} < 1.5 \tag{2}$$

The inventors examined and found that heat exchange performance can be optimized when the condition of formula (2) is satisfied. In particular, the inventors found that, when the heat exchanger 10 according to one or more embodiments is used as an evaporator, frosting can be suppressed, and air passage resistance can be optimized.

(5-4) Modification D

Figure 14:
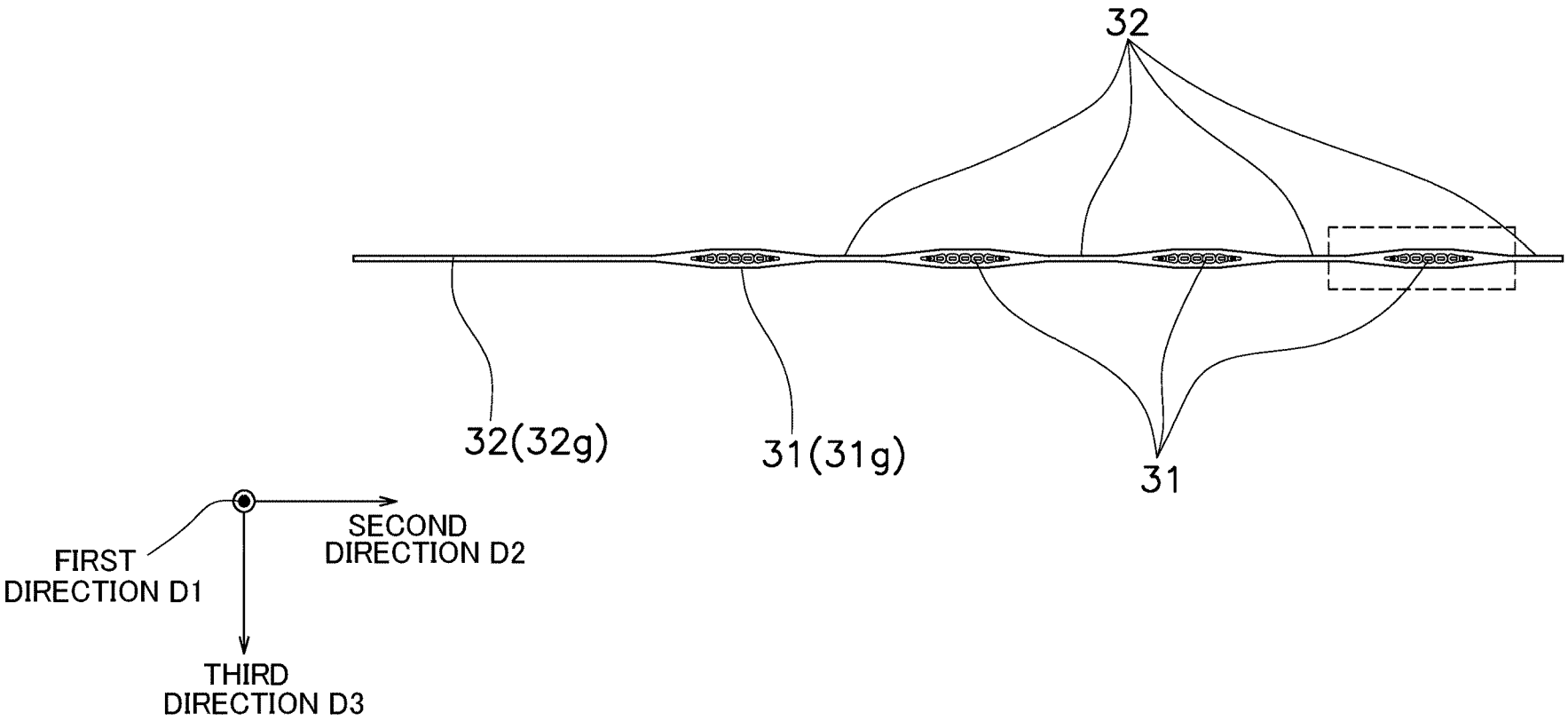
FIG. 14 is a schematic view for describing the configuration of a heat transfer unit 30 according to a modification D.
Figure 15:
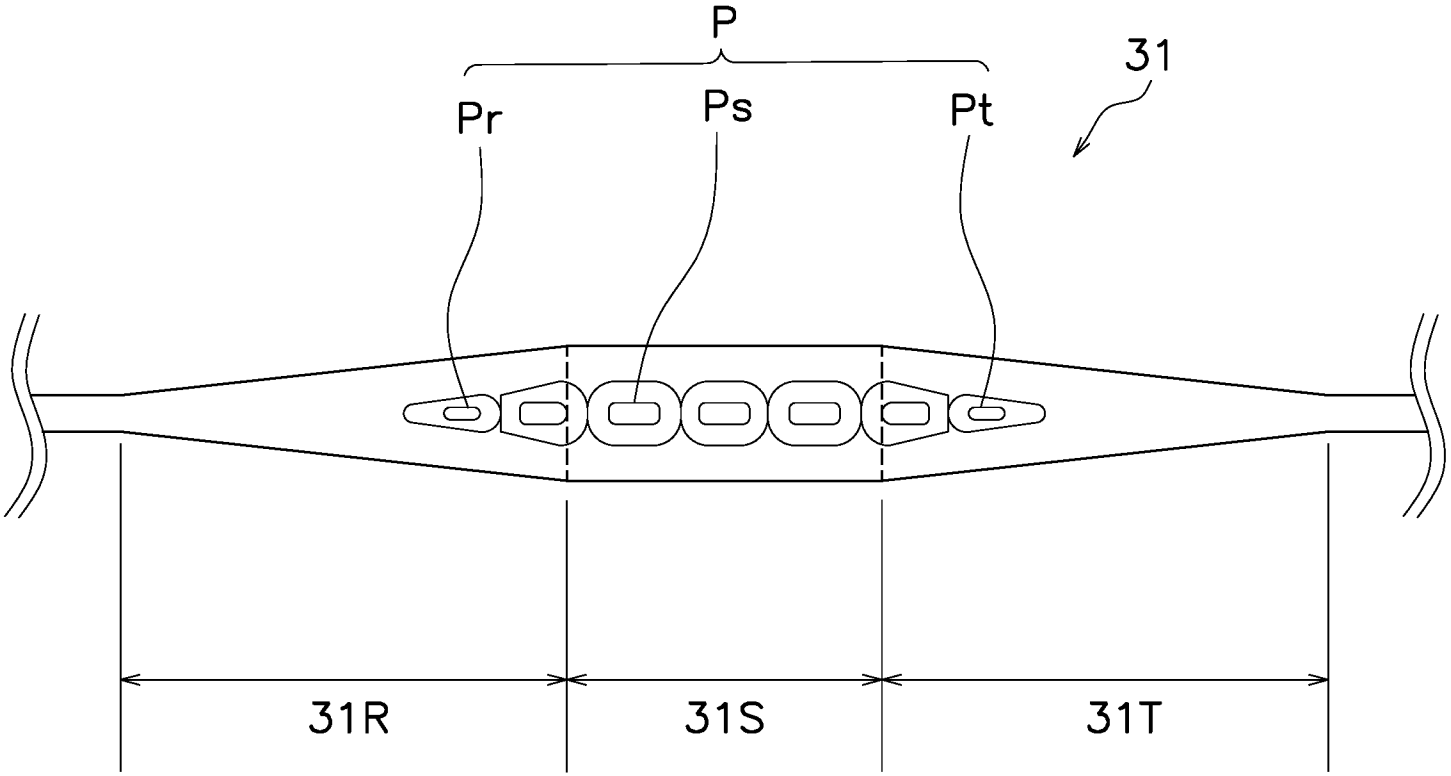
FIG. 15 is schematic view for describing the configuration of a heat transfer unit 30 according to the modification D (partial enlarged view of FIG. 14).

As illustrated in FIGS. 14 and 15, the heat transfer channel portion 31 may include an airflow-upstream portion 31R, a middle portion 31S, and an airflow-downstream portion 31T, from an end portion side in the second direction D2. Here, the thickness of the heat transfer channel portion 31 increases from the airflow-upstream portion 31R toward the middle portion 31S. The thickness decreases from the middle portion 31S toward the airflow-downstream portion 31T.

With the heat exchanger 10 having such a configuration, when air flows from the first auxiliary heat transfer portion 32*g*, flow of air is guided by the airflow-upstream portion 31R and the airflow-downstream portion 31T, which exist at the front and back of the middle portion 32S, and dead water zone can be reduced. As a result, the heat flux distribution of air that passes through the inside of the heat transfer unit 30 can be made uniform. Here, the term "dead water zone" refers to a region where movement of air is inactive. If a dead water zone exists, movement of heat between air and the heat transfer unit is impeded, and the heat transfer performance of the heat exchanger 10 decreases.

The heat transfer channel portions 31 may include a plurality of pipes P. Such a configuration enables a channel having an optimal channel cross-sectional area to be easily formed. Moreover, in the heat transfer channel portion 31 including a plurality of pipes P, the cross-sectional area of pipes Pr and Pt, which are formed in the airflow-upstream portion 31R and/or the airflow-downstream portion 31T, may be smaller than the cross sectional area of a pipe Ps formed in the middle portion 31S. Thus, the heat transfer channel portion 32 including the middle portion 31S, which has a large film thickness, can be easily formed. Moreover, in the second direction D2, the length of the airflow-upstream portion 31R may be smaller than the length of the airflow-downstream portion 31T. Such a configuration can further reduce a dead water zone.

(5-5) Modification E

Figure 16:
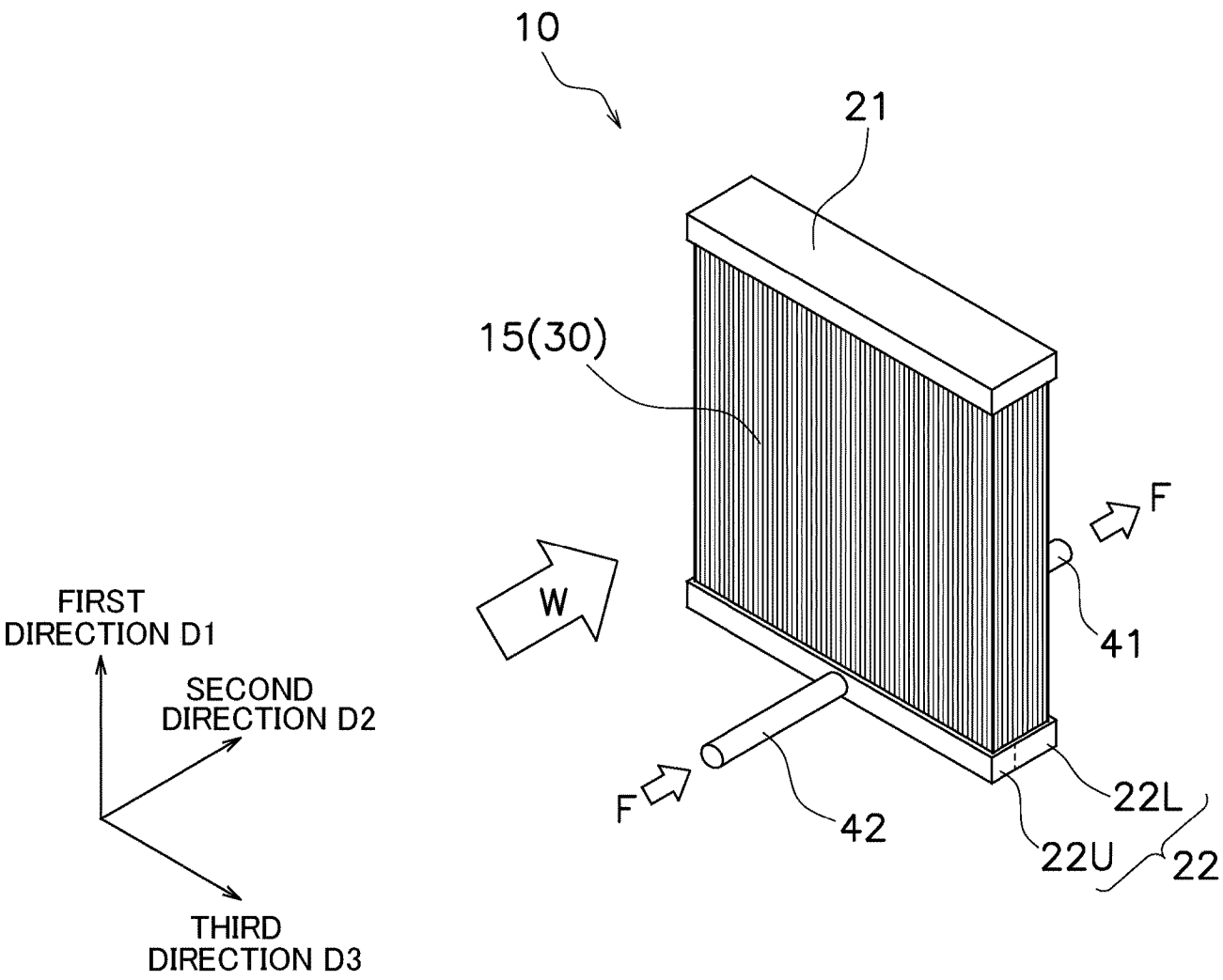
FIG. 16 is a schematic view for describing a refrigerant channel of a heat exchanger 10 according to a modification E.

In the heat exchanger 10 according to one or more embodiments, the refrigerant channel may be folded back at least once in the second direction D2 in which airflow W is generated. For example, a refrigerant channel illustrated in FIG. 16 may be used. Here, the inside of the second header 22 is divided into an airflow-upstream second header 22U on the airflow-upstream side and an airflow-downstream second header 22L on the airflow-downstream side, the second pipe 42 is connected to the airflow-upstream second header 22U, and the first pipe 41 is connected to the airflow-downstream second header 22L.

With such a configuration, due to pressure loss, the refrigerant temperature in the heat transfer channel portion 31 that exists on the airflow-upstream side (hereafter, also referred to as an airflow-upstream heat transfer channel portion) increases. Therefore, when the heat exchanger 10 is used as an evaporator, heat exchange amount in the airflow-upstream heat transfer channel portion is suppressed. Thus, variation of heat flux in accordance with the position in the heat transfer unit group 15 can be suppressed. As a result, when the heat exchanger 10 is used as an evaporator in a low temperature environment (for example, 7° C. or lower), local occurrence of frosting can be avoided, and a heat exchanger having high heat exchange performance can be provided.

With such a configuration, because all of the refrigerant F flowing in from the second pipe 42 can be temporarily caused to flow through the airflow-upstream heat transfer channel portion, the refrigerant is prevented from completely evaporating in the airflow-upstream heat transfer channel portion. As a result, the heat exchange performance of the heat exchanger 10 can be optimized.

(5-6) Modification F

Figure 17:
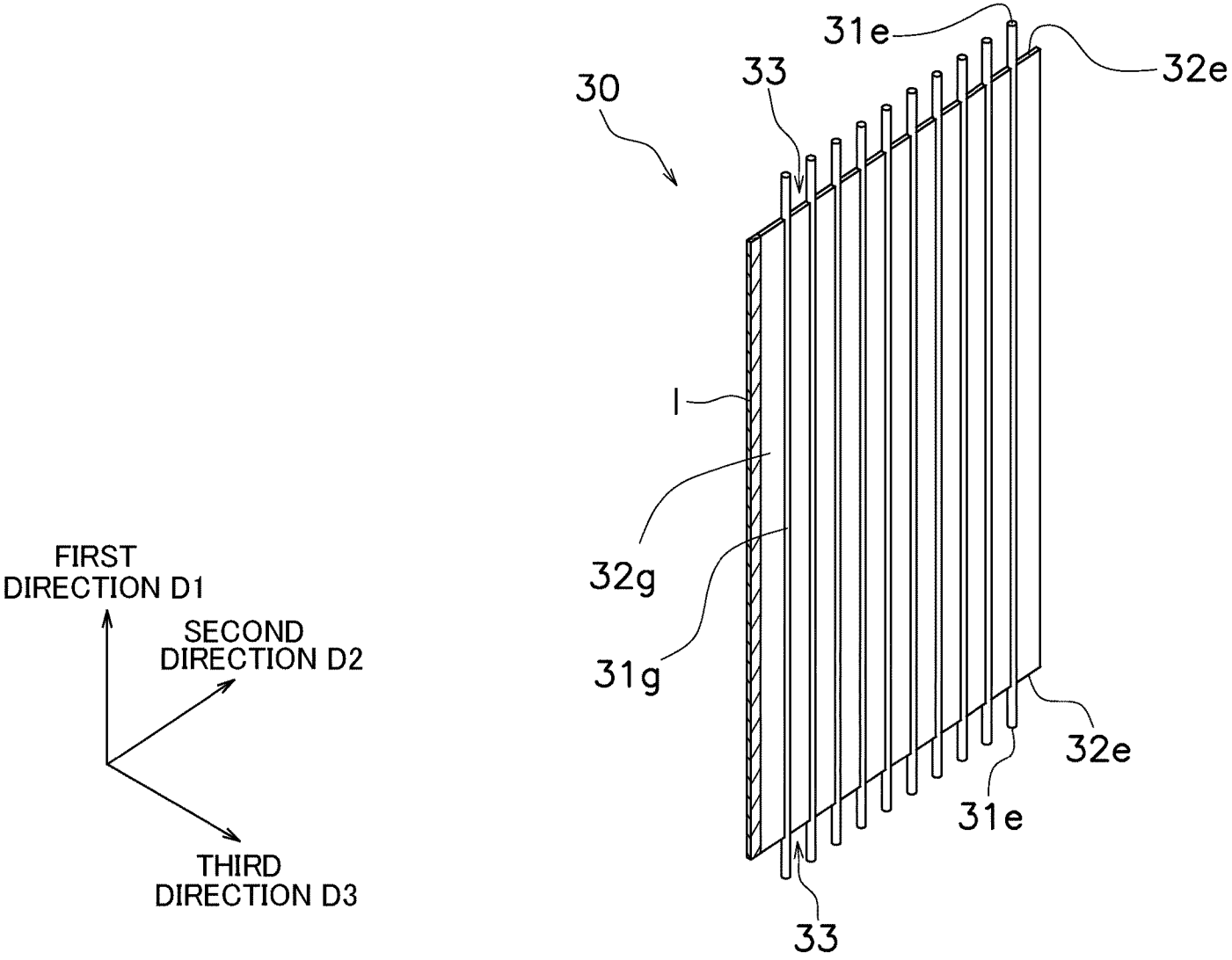
FIG. 17 is a schematic view for describing a heat transfer unit 30 according to a modification F.
Figure 18:
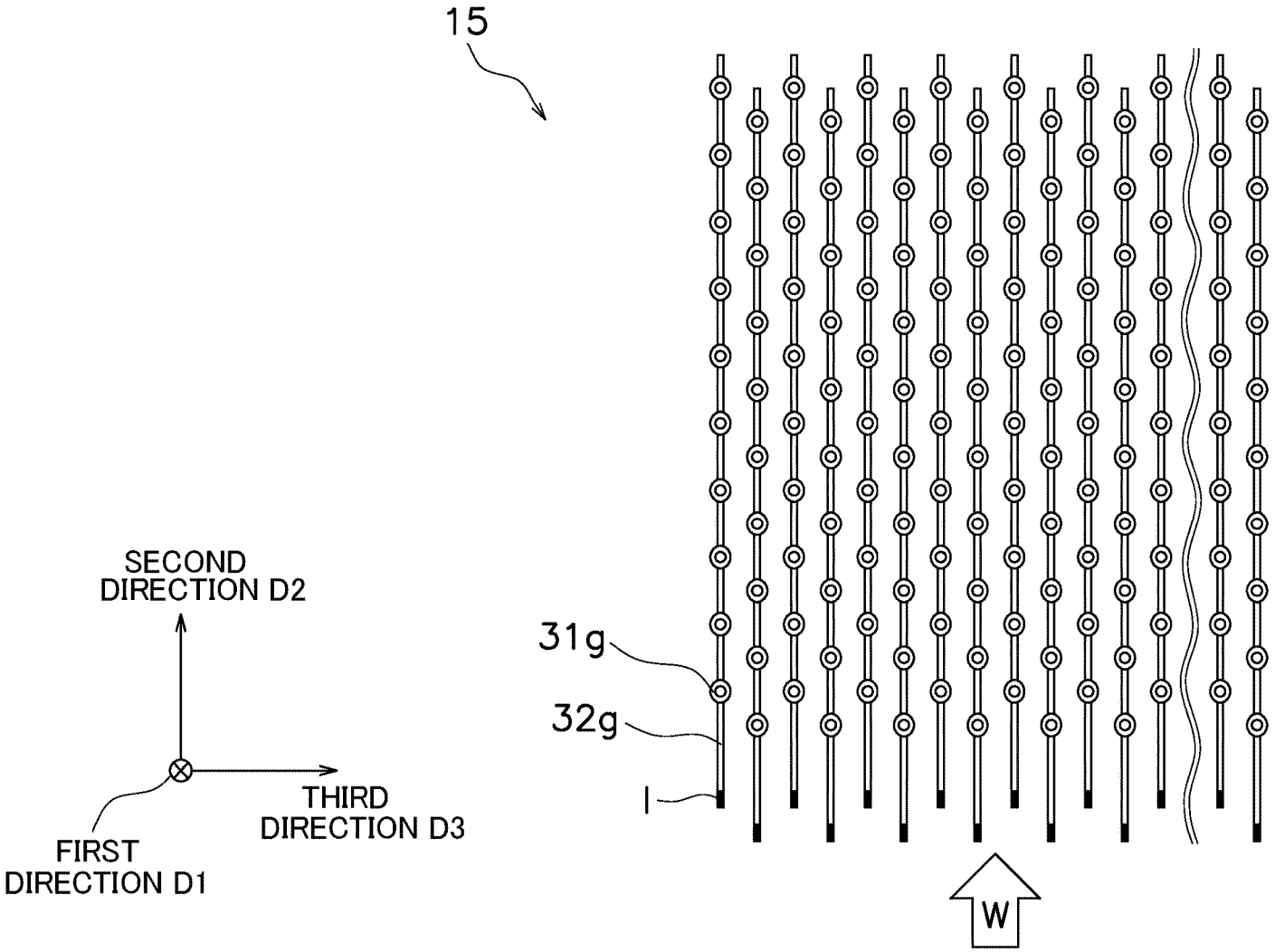
FIG. 18 is a schematic view for describing a heat transfer unit group 15 according to the modification F.

In the heat exchanger 10 according to one or more embodiments, when seen in the first direction D1, a heat insulator I may be applied to an end portion of the heat transfer unit 30 on the airflow-upstream side in the second direction D2 (here, the auxiliary heat transfer portion 32*g*) (see FIGS. 17 and 18). Thus, decrease of temperature at the end portion can be suppressed. As a result, when the heat exchanger 10 is used as an evaporator in a low temperature environment (for example, 7° C. or lower), frosting can be suppressed, and blockage of the air passage can be avoided or retarded.

In the example illustrated in FIGS. 17 and 18, the end portion of the heat transfer unit 30 is the auxiliary heat transfer portion 32*g*. Moreover, the auxiliary heat transfer portion 32*g* on the most airflow-upstream side (first auxiliary heat transfer portion) has a closed shape. Here, the term "closed shape" refers to a flat shape without a hole or a cutout. Thus, water-drainage performance during a defrosting operation can be further increased.

To be more specific, if a hole, a cutout, or the like is formed in the auxiliary heat transfer portion 32*g*, water generated by defrosting may be retained in the hole, the cutout, or the like. In this case, next frosting may spread from a portion where water is retained. In contrast, with the heat exchanger 10 according to the modification F, because the auxiliary heat transfer portion 32*g* has a shape without a hole, a cutout, or the like, occurrence of frosting after a defrosting operation can be suppressed.

(5-7) Modification G

The heat transfer channel portion 31 according to one or more embodiments is not limited to the one described above, and may have another configuration. For example, the cross-sectional shape of the heat transfer channel portions 31 when seen in the first direction D1 may be any of: a semicircular shape, an elliptical shape, a flat shape, a shape like an upper half of an airfoil, and/or a shape like a lower half of an airfoil; or any combination of these. In short, the heat exchanger 10 may have any shape that optimizes heat exchange performance.

(5-8) Modification H

Figure 19:
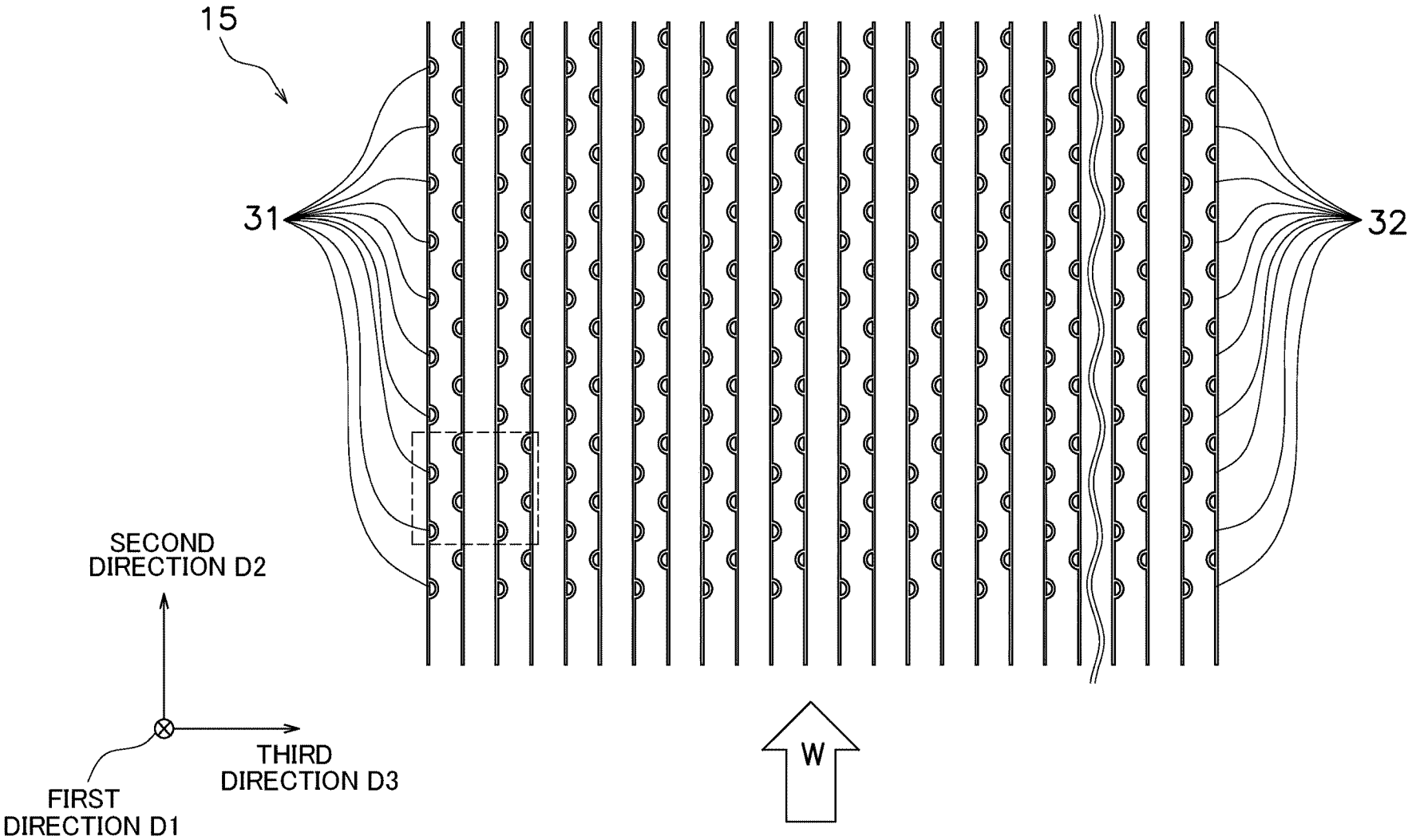
FIG. 19 is schematic view for describing the configuration of a heat transfer unit group 15 according to a modification H.
Figure 20:
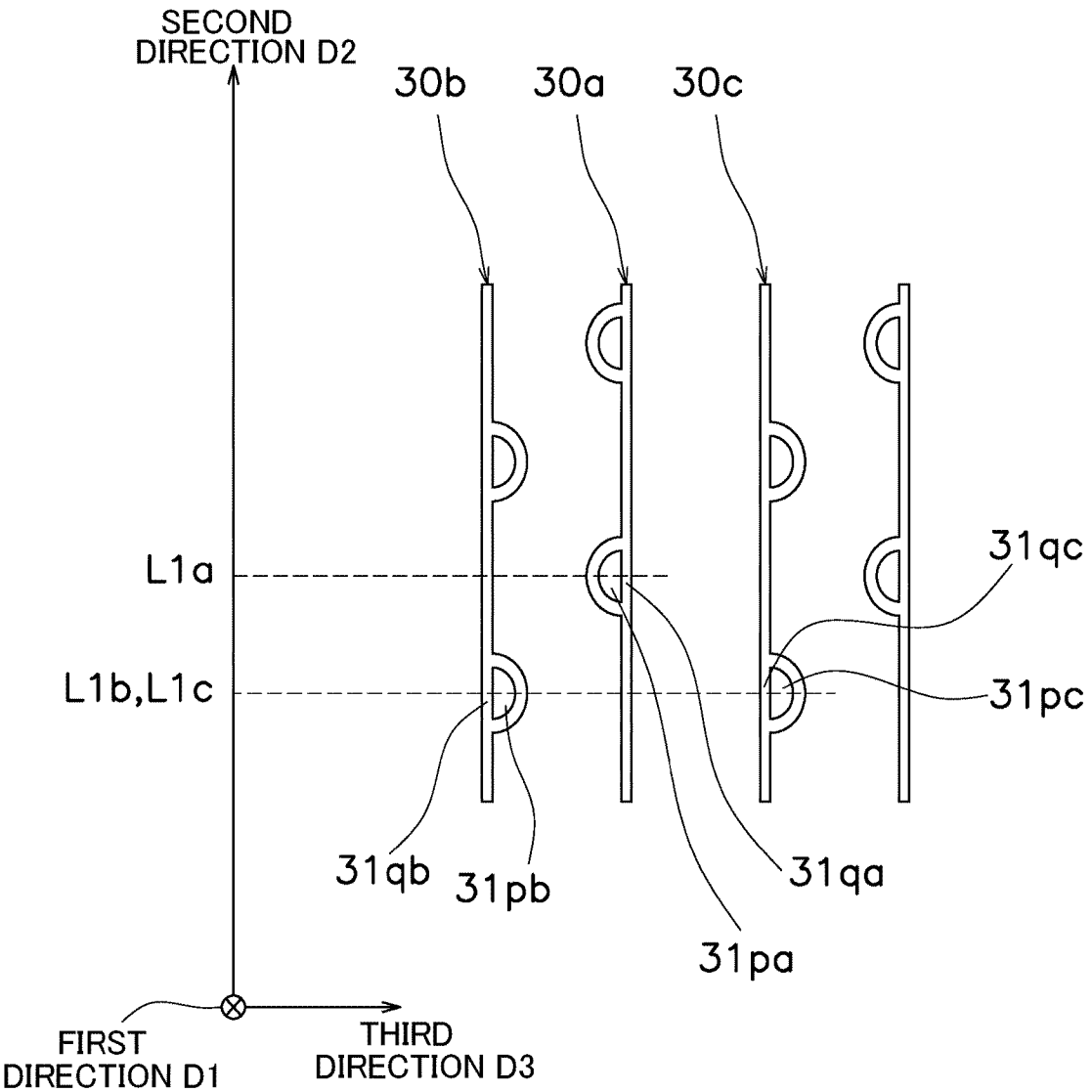
FIG. 20 is schematic view for describing the configuration of a heat transfer unit group 15 according to the modification H (partial enlarged view of FIG. 19).

The heat transfer unit group 15 according to one or more embodiments may have a configuration as illustrated in FIGS. 19 and 20. FIG. 20 is a partial enlarged view of FIG. 19 (corresponding to a dotted-line part of FIG. 19).

In the example illustrated in FIGS. 19 and 20, the heat transfer unit 30 (including 30*a*, 30*b*, and 30*c*) includes a first bulging portion 31*p* (including 31*pa*, 31*pb*, and 31*pc*) that bulges at a first position L1 (including L1*a*, L1*b*, and L1*c*) in the second direction D2 and forms the heat transfer channel portion 31, and a first flat surface portion 31*q* (including 31*qa*, 31*qb*, and 31*qc*) that is formed at the first position L1 so as to face in a direction opposite from the direction in which the first bulging portion 31*p* is formed. In the modification H, the "first position" is defined for each heat transfer unit, and the first position L1*a* of the heat transfer unit 30*a* and the first positions L1*b* and L1*c* of the heat transfer units 30*b* and 30*c* are different positions.

Moreover, at least one heat transfer unit 30*a* is disposed in a direction such that, with respect to a heat transfer unit 30*b* adjacent on one side, a surface on which the first bulging portion 31*pa* is formed and a surface of the adjacent heat transfer unit 30*b* on which the first bulging portion 31*pb* is formed face each other. The heat transfer unit 30*a* is disposed in a direction such that, with respect to the heat transfer unit 30*c* adjacent on the other side, a surface on which the first flat surface portion 31*qa* is formed and a surface of the other heat transfer unit 30*c* on which the first flat surface portion 31*qc* is formed face each other.

With such a configuration, when the heat exchanger 10 is used as an evaporator, because airflow straightly passes through an air passage in which the first flat surface portions 31*qa* and 31*qc* face each other, the generation amount of frost can be suppressed. Thus, heat exchange performance can be increased depending on a use environment.

In an air passage in which the first bulging portions 31*pa* and 31*pb* face each other, contraction of airflow occurs, and frost is likely to concentratedly occur in the air passage. However, even if such frosting occurs, depending on a use environment, the heat exchange performance of the entirety of the heat exchanger can be increased, compared with a heat exchanger in which substantially the same bulging portions are formed on both surfaces of the heat transfer units as illustrated in FIG. 12.

Moreover, as illustrated in FIG. 20, in the heat exchanger 10 according to the modification H, when seen in the first direction D1, the first positions L1*a* and L1*b* of the adjacent heat transfer units 30*a* and 30*b* are arranged so as not to overlap. In other words, in the air passage between the adjacent heat transfer units 30*a* and 30*b*, the first bulging portions 31*pa* and 30*pb* are arranged in a staggered pattern. Therefore, the channel cross-sectional area of the air passage between the adjacent heat transfer units 31*a* and 31*b* can be increased, compared with a configuration in which the bulging portions are disposed close to each other as illustrated in FIG. 12. Accordingly, when the heat exchanger 10 is used as an evaporator in a low temperature environment (for example, 7° C. or lower), blockage of the air passage due to frosting can be further suppressed.

Furthermore, the heat transfer unit 30 may have a second bulging portion that bulges to a smaller degree than the first bulging portion 31*p*, instead of the first flat surface portion 31*q*. An argument similar to that described above also applies to this case.

(5-9) Modification I

Figure 21:
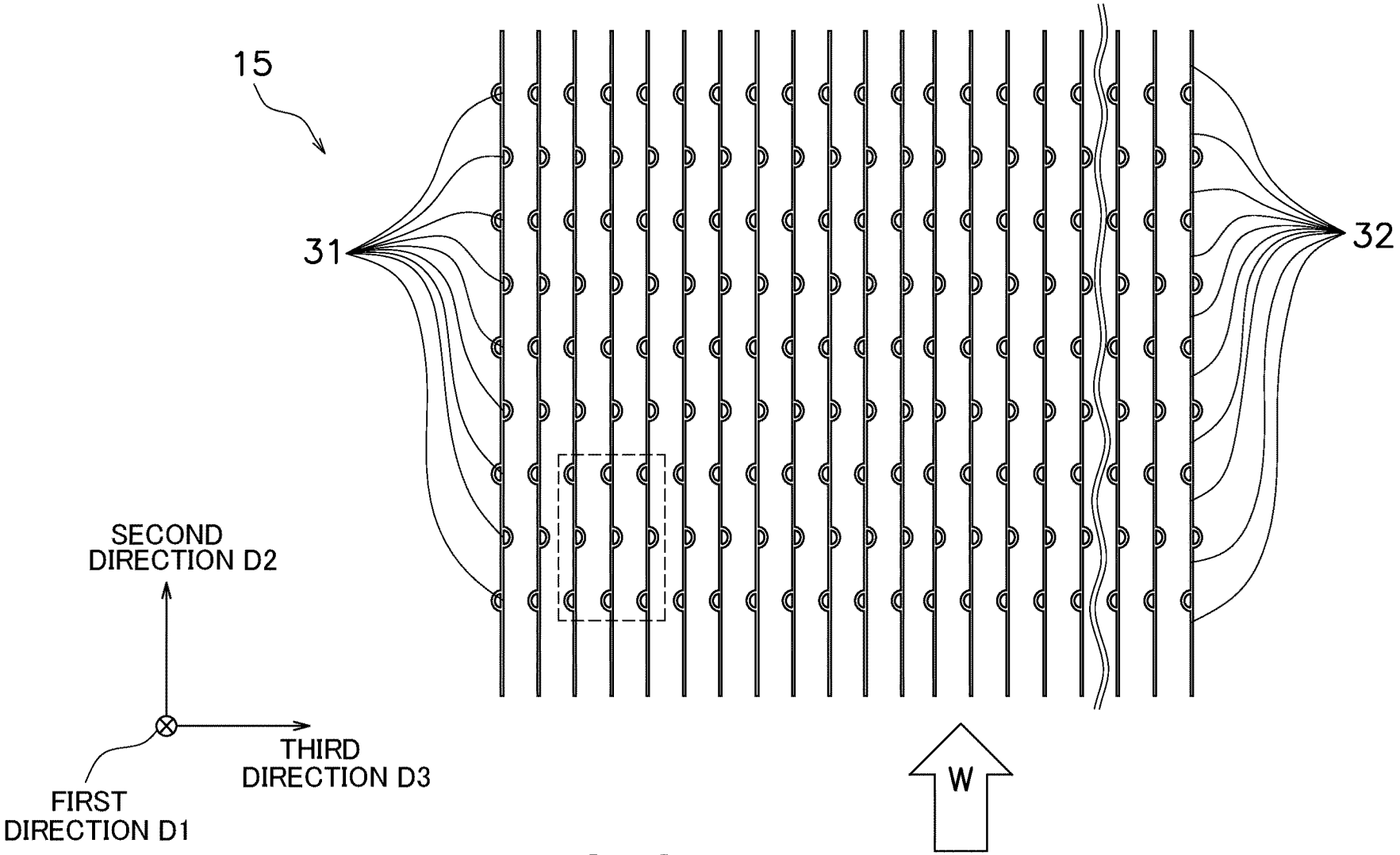
FIG. 21 is a schematic view for describing the configuration of a heat transfer unit group 15 according to a modification I.
Figure 22:
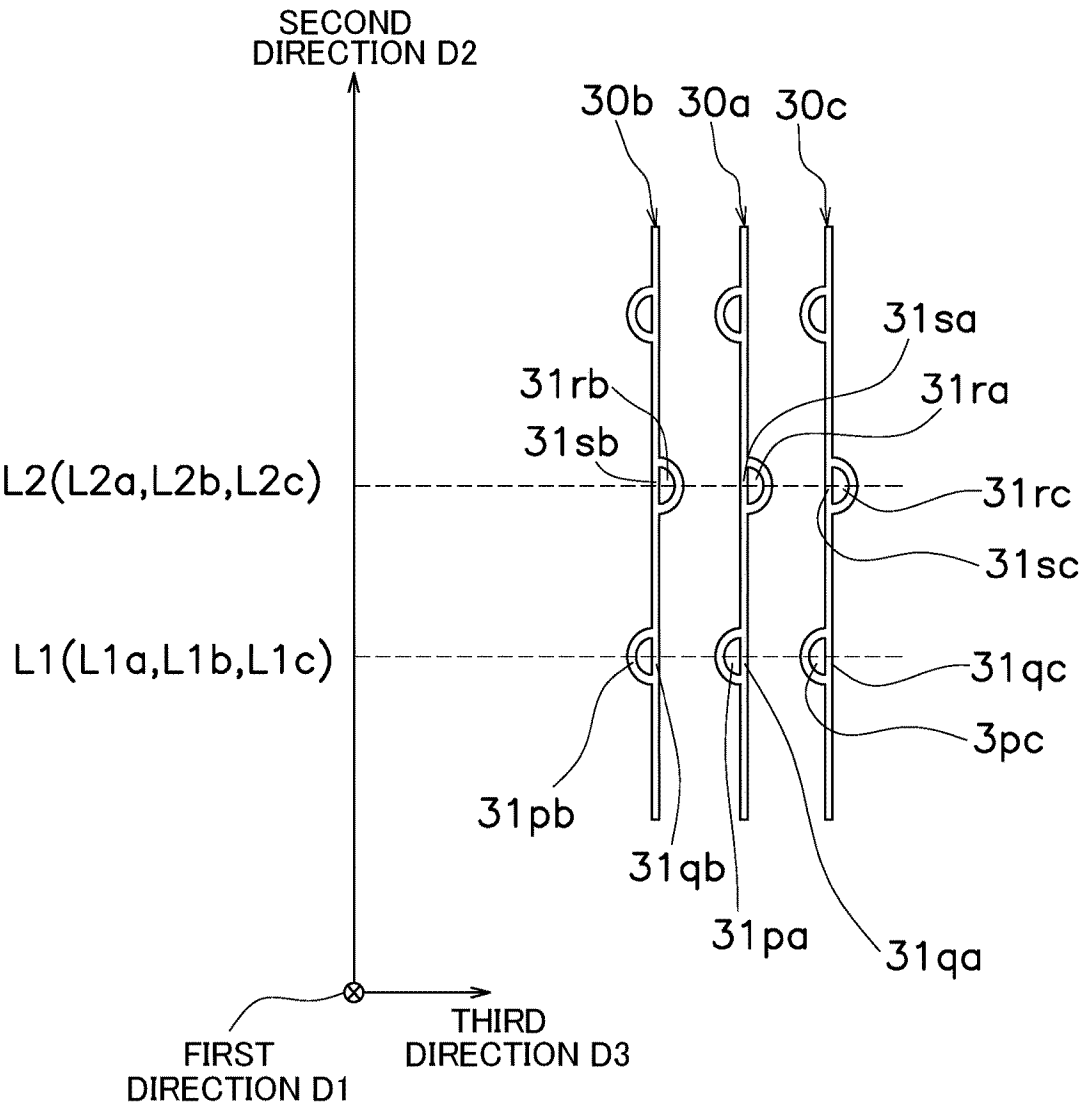
FIG. 22 is schematic view for describing the configuration of a heat transfer unit group 15 according to the modification I (partial enlarged view of FIG. 21).

The heat transfer unit group 15 according to one or more embodiments may have a configuration as illustrated in FIGS. 21 and 22. FIG. 22 is a partial enlarged view of FIG. 21 (corresponding to a dotted-line part of FIG. 21).

In the example illustrated in FIGS. 21 and 22, the heat transfer unit 30 (including 30*a*, 30*b*, and 30*c*) includes: a first bulging portion 31*p* (including 31*pa*, 31*pb*, and 31*pc*) that bulges at a first position L1 (including L1*a*, L1*b*, and L1*c*) in the second direction D2 and forms the heat transfer channel portion 31; a first flat surface portion 31*q* (including 31*qa*, 31*qb*, and 31*qc*) that is formed at the first position L1 so as to face in a direction opposite from the direction in which the first bulging portion 31*p* is formed; a third bulging portion 31*r* (including 31*ra*, 31*rb*, and 31*rc*) that bulges at a second position L2 (including L2*a*, L2*b*, and L2*c*) in the second direction D2 so as to face in a direction opposite from the direction in which the first bulging portion 31*p* is formed, and that forms the heat transfer channel portion 31; and a second flat surface portion 31*s* (including 31*sa*, 31*sb*, and 31*sc*) that is formed at the second position L2 so as to face in a direction opposite from the direction in which the third bulging portion 31*r* is formed. Here, the first bulging portion 31*p* and the third bulging portion 31*r* have the same shape. The first bulging portion 31*p* and the third bulging portion 31*r* are adjacent to each other in the second direction D2.

Moreover, at least one heat transfer unit 30*a* is disposed in a direction such that, with respect to a heat transfer unit 30*b* adjacent on one side, a surface on which the first bulging portion 31*pa* is formed and a surface of the adjacent heat transfer unit 30*b* on which the first flat portion 31*qb* is formed face each other. The heat transfer unit 30*a* is disposed in a direction such that, with respect to the heat transfer unit 30*c* adjacent on the other side, a surface on which the third bulging portion 31*ra* is formed and a surface of the other adjacent heat transfer unit 30*c* on which the second flat surface portion 30*sc* is formed face each other.

Furthermore, the first positions L1*a* and L1*b* (or L1*a* and L1*c*) in the adjacent heat transfer units 30*a* and 30*b* (or 30*a* and 30*c*) are arranged so as to overlap when seen in the first direction D1. The second positions L2*a* and L2*b* (or L2*a* and L2*c*) are arranged so as to overlap when seen in the first direction D1. To be more specific, although the "first position L1" and the "second position L2" are defined for each heat transfer unit, here, these positions are the same in the heat transfer units 30*a*, 30*b*, and 30*c*.

In short, in the heat exchanger 10 according to the modification I, between adjacent heat transfer units 30*a* and 30*b*, the first bulging portions 31*pa* and 31*pb* and the like do not face each other, but are formed in opposite directions. Therefore, compared with a configuration in which the first bulging portions 31*pa* and 31*pb* and the like face each other, occurrence of contraction flow can be suppressed. As a result, it is possible to suppress increase of airflow resistance, and to realize optimal heat exchange performance. With the heat exchanger 10 having a configuration described above, when used as an evaporator (for example, 7° C. or lower), local frosting can be suppressed, compared with a heat exchanger in which substantially the same bulging portions are formed on both sides of the heat transfer units as illustrated in FIG. 12.

The heat transfer unit 30 may have a second bulging portion that bulges to a smaller degree than the first bulging portion 31*p*, instead of the first flat surface portion 31*q*. The heat transfer unit 30 may have a fourth bulging portion that bulges to a smaller degree than the third bulging portion 31*r*, instead of the second flat surface portion 31*s*. An argument similar to that described above also applies to these cases.

(5-10) Modification J

Figure 23:
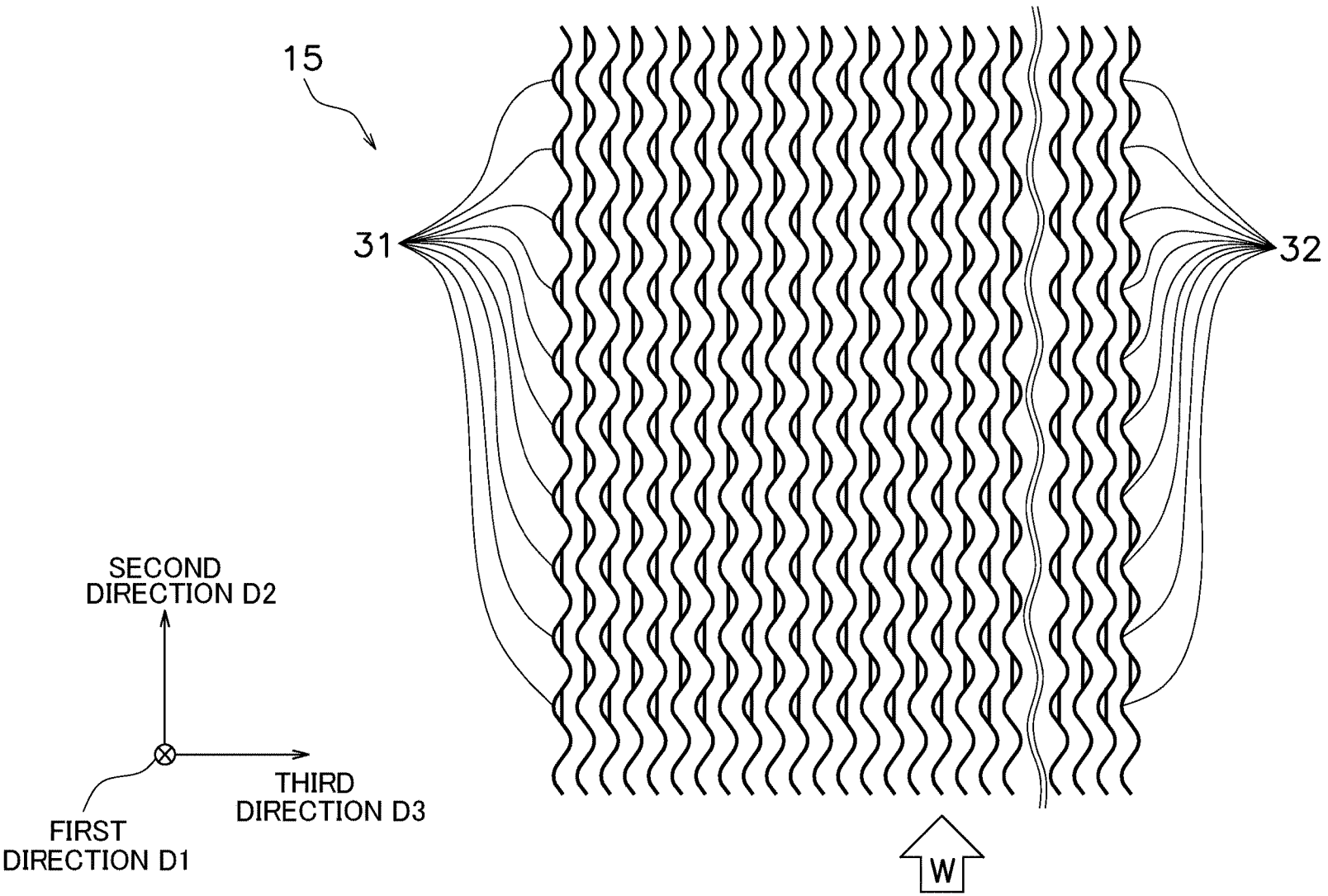
FIG. 23 is schematic view for describing the configuration of a heat transfer unit group 15 according to a modification J.

As illustrated in FIG. 23, in the heat exchanger 10 according to one or more embodiments, when seen in the first direction D1, the heat transfer unit 30 may be processed so as to have a wave-like shape in addition to a linear shape. When the heat transfer unit 30 has a linear shape, air passage resistance can be suppressed. On the other hand, when the heat transfer unit 30 has a wave-like shape, heat exchange amount between airflow and a refrigerant can be increased. In short, it is possible to provide a heat exchanger having optimal heat exchange performance in accordance with a use environment.

(5-11) Modification K

The heat exchanger 10 according to one or more embodiments can be applied to a vessel heat exchanger (small-diameter multi-pipe heat exchanger) in which heat transfer tubes and fins are arranged in one direction. However, the heat exchanger 10 is not limited to this configuration. For example, application to a microchannel heat exchanger (flat multi-hole-pipe heat exchanger) is also possible.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

10 heat exchanger
21 first header (upper header)

22 second header (lower header)
30 heat transfer unit
30*a* heat transfer unit (one heat transfer unit)
30*b* heat transfer unit (heat transfer unit adjacent on one side)
30*c* heat transfer unit (heat transfer unit adjacent on the other side)
31 heat transfer channel portion
31*p* first bulging portion
31*q* first flat surface portion
31*r* third bulging portion
31*s* second flat surface portion
31R airflow-upstream portion
31S middle portion
31T airflow-downstream portion
32 auxiliary heat transfer portion
32*g* auxiliary heat transfer portion at end portion in second direction (first auxiliary heat transfer portion)
D1 first direction
D2 second direction
D3 third direction
I heat insulator
L1 first position
L2 second position
S first length

PATENT LITERATURE

Patent Literature 1: Japanese Unexamined Patent Application Publication No. 2006-90636

The invention claimed is:

1. A heat exchanger comprising:

a first heat transfer unit that comprises a plurality of heat transfer channel portions and auxiliary heat transfer portions, wherein the plurality of heat transfer channel portions and the auxiliary heat transfer portions extend in a first direction, each of the plurality of heat transfer channel portions and each of the auxiliary heat transfer portions are alternately disposed in a second direction that intersects with or is perpendicular to the first direction, the plurality of heat transfer channel portions are disposed with a pitch in the second direction, a first auxiliary heat transfer portion among the auxiliary heat transfer portions is disposed at an end of the first heat transfer unit in the second direction, a first heat transfer channel portion among the plurality of heat transfer channel portions is disposed adjacent to the first auxiliary heat transfer portion in the second direction, a distal end of the first auxiliary heat transfer portion away from the first heat transfer channel portion when viewed in the first direction is away from the first heat transfer channel portion by a first length in the second direction, the first length is larger than the pitch, and a length of each of the auxiliary heat transfer portions in the second direction is larger than a thickness of a wall of the first heat transfer channel portion.

2. The heat exchanger according to claim 1, wherein, in the first heat transfer unit, the plurality of heat transfer channel portions and the auxiliary heat transfer portions are integrally formed by extrusion of aluminum.

3. The heat exchanger according to claim 2, wherein, when viewed from the first direction, a thickness of each of the auxiliary heat transfer portions is smaller than twice a thickness of the first heat transfer channel portion.

4. The heat exchanger according to claim 1, wherein $s>11\sqrt{t}$, where S is the first length and t is a thickness of the first auxiliary heat transfer portion when seen in the first direction.

5. The heat exchanger according to claim 1, wherein the first heat transfer channel portion comprises, from a side of the end of the first heat transfer unit in the second direction:

an airflow-upstream portion;

a middle portion; and an airflow-downstream portion, a thickness of the first heat transfer channel portion increases from the airflow-upstream portion toward the middle portion, and the thickness decreases from the middle portion toward the airflow-downstream portion.

6. The heat exchanger according to claim 5, wherein the first heat transfer channel portion comprises pipes.

7. The heat exchanger according to claim 6, wherein, in the first heat transfer channel portion, a cross-sectional area of a pipe formed in at least one of the airflow-upstream portion or the airflow-downstream portion is smaller than a cross-sectional area of a pipe formed in the middle portion.

8. The heat exchanger according to claim 5 wherein, in the second direction, a length of the airflow-upstream portion is smaller than a length of the airflow-downstream portion.

9. An air conditioner comprising the heat exchanger according to claim 1.

* * * * *